US008688017B2

(12) United States Patent
Shimizu et al.

(10) Patent No.: US 8,688,017 B2
(45) Date of Patent: Apr. 1, 2014

(54) IMAGE FORMATION UNIT AND IMAGE FORMATION APPARATUS

(75) Inventors: Takatoku Shimizu, Tokyo (JP); Hidetaka Mitsunobu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 109 days.

(21) Appl. No.: 13/416,001

(22) Filed: Mar. 9, 2012

(65) Prior Publication Data

US 2012/0230734 A1 Sep. 13, 2012

(30) Foreign Application Priority Data

Mar. 11, 2011 (JP) ..... 2011-053783
Jun. 10, 2011 (JP) ..... 2011-129758

(51) Int. Cl.
*G03G 15/08* (2006.01)

(52) U.S. Cl.
USPC ..... 399/281; 399/258

(58) Field of Classification Search
USPC ..... 399/281, 283, 272, 273, 258
See application file for complete search history.

(56) References Cited

U.S. PATENT DOCUMENTS

| | | | | | |
|---|---|---|---|---|---|
| 5,809,386 | A * | 9/1998 | Iwata | 399/281 |
| 5,832,350 | A * | 11/1998 | Kumasaka et al. | 399/272 X |
| 5,839,021 | A * | 11/1998 | Hayashi et al. | 399/281 X |
| 6,041,208 | A * | 3/2000 | Choi | 399/281 |
| 7,221,892 | B2 * | 5/2007 | Sato | 399/283 |
| 7,885,583 | B2 * | 2/2011 | Shigehiro | 399/272 |
| 2006/0280528 | A1 * | 12/2006 | Do | 399/281 X |
| 2008/0008504 | A1 * | 1/2008 | Campbell et al. | 399/281 |
| 2011/0150525 | A1 * | 6/2011 | Fujiwara et al. | 399/111 |

FOREIGN PATENT DOCUMENTS

| | | | |
|---|---|---|---|
| JP | 08-095367 | A * | 4/1996 |
| JP | 10-039628 | A | 2/1998 |
| JP | 11-030912 | A * | 2/1999 |

* cited by examiner

*Primary Examiner* — Sophia S Chen
(74) *Attorney, Agent, or Firm* — Marvin A. Motsenbocker; Mots Law, PLLC

(57) ABSTRACT

An image formation unit includes an image carrier, a developer carrier configured to supply developer to the image carrier to form a developer image on the image carrier, first and second developer supply members configured to supply the developer to the developer carrier, a first developer container room configured to contain therein the developer and accommodating therein the first developer supply member, and a second developer container room configured to contain therein the developer and accommodating therein the second developer supply member.

20 Claims, 23 Drawing Sheets

FIRST EMBODIMENT

FIRST EMBODIMENT

FIRST COMPARISON EXAMPLE

SECOND COMPARISON EXAMPLE

FIRST MODIFICATION

SECOND MODIFICATION

THIRD MODIFICATION

SECOND EMBODIMENT

THIRD EMBODIMENT

THIRD EMBODIMENT

THIRD EMBODIMENT

THIRD EMBODIMENT

COMPARISON EXAMPLE

THIRD EMBODIMENT

COMPARISON EXAMPLE

FOURTH EMBODIMENT

FOURTH EMBODIMENT

FOURTH EMBODIMENT

FOURTH EMBODIMENT

IMAGE FORMATION UNIT AND IMAGE FORMATION APPARATUS

CROSS REFERENCE TO RELATED APPLICATIONS

This application claims priority based on 35 USC 119 from prior Japanese Patent Application No. 2011-053783 filed on Mar. 11, 2011, entitled "image formation unit and image formation apparatus" and prior Japanese Patent Application No. 2011-129758 filed on Jun. 10, 2011, entitled "DEVELOPMENT DEVICE, IMAGE FORMATION UNIT AND IMAGE FORMATION APPARATUS", the entire contents of which are incorporated herein by reference.

BACKGROUND OF THE INVENTION

1. Field of the Invention

The present disclosure relates to an electrophotographic image formation unit and image formation apparatus such as a printer, a copy machine, or the like.

2. Description of Related Art

An electrophotographic image formation apparatus uniformly charges a surface of a photosensitive drum (an image carrier) by a charge device, emits light onto the charged surface of the photosensitive drum by an exposure device to form an electrostatic latent image on the charged surface, develops the electrostatic latent image with toner (developer) by a development device to form a toner image (a developer image), and then transfers the toner image onto a recording medium such as a sheet of paper. The development device includes a development roller (serving as a developer carrier) disposed facing the photosensitive drum, to attach the toner to the electrostatic latent image on the photosensitive drum.

Recently, to suppress a variation of an image density, there has been suggested a development device that includes two supply rollers disposed in contact with a development roller to supply an adequate amount of toner to the development roller (see, Japanese Patent Application Laid-Open No. 10-39628, for example)

SUMMARY OF THE INVENTION

However, even if two supply rollers are provided, a good image quality may not be obtained.

An object of an embodiment of the invention is to improve an image quality.

A first aspect of the invention is an image formation unit includes: an image carrier on which a latent image can be formed; a developer carrier configured to retain a developer thereon and to supply the developer to the image carrier to form a developer image on the image carrier; a first developer supply member configured to retain the developer thereon and to supply the developer to the developer carrier; a second developer supply member provided above the first developer supply member and configured to retain the developer thereon and to supply the developer to the developer carrier; a developer container part configured to contain therein the developer and accommodating therein the first and second developer supply members; and a developer supply prompt structure configured to prompt a supply of the developer to the first developer supply member in the developer container part.

A second aspect of the invention is an image formation unit including: an image carrier on which a latent image can be formed; a developer carrier configured to retain a developer thereon and to supply the developer to the image carrier to form a developer image on the image carrier; a first developer supply member configured to retain the developer thereon and to supply the developer to the developer carrier; a second developer supply member provided above the first developer supply member, configured to retain the developer thereon and to supply the developer to the developer carrier; and a developer container part configured to contain therein the developer and accommodating therein the first and second developer supply members, wherein the first developer supply member protrudes out further than the second developer supply member toward an opposite side of the developer carrier.

A third aspect of the invention is an image formation unit including: an image carrier on which a latent image can be formed; a developer carrier configured to retain a developer thereon and to supply the developer to the image carrier to form a developer image on the image carrier; a first developer supply member configured to retain the developer thereon and to supply the developer to the developer carrier; a second developer supply member configured to retain the developer thereon and to supply the developer to the developer carrier; a first developer container room configured to contain therein the developer and accommodating therein the first developer supply member; and a second developer container room configured to contain therein the developer and accommodating therein the second developer supply member.

According to one of the aspects of the invention, the image quality is improved.

DETAILED DESCRIPTION OF THE EMBODIMENTS

Figure 1:
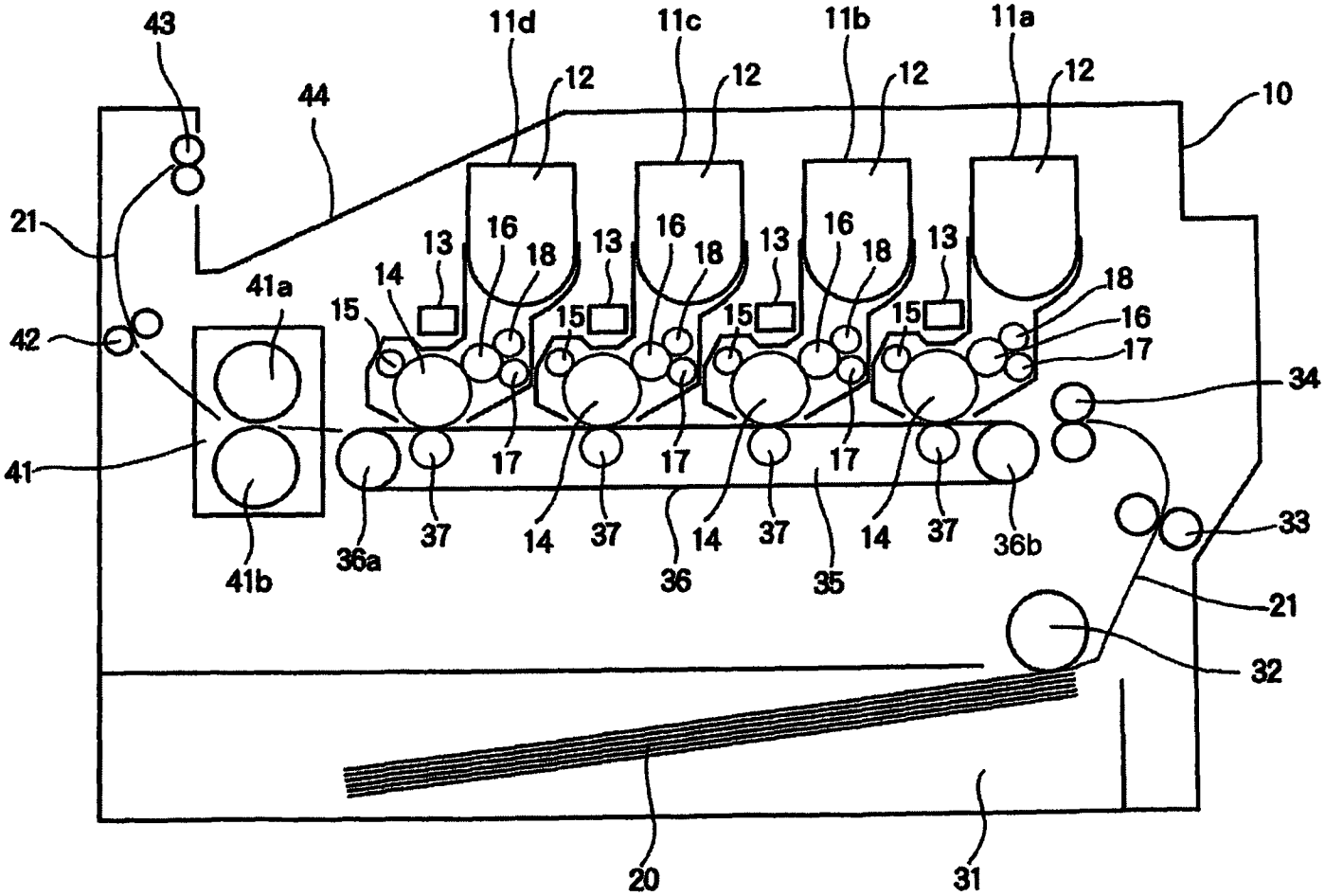
FIG. 1 is a side view of an outline configuration of an image formation apparatus according to a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

《1》 [First Embodiment]

FIG. 1 is a view of an outline configuration of image formation apparatus 10 according to a first embodiment of the invention. Image formation apparatus 10 is, for example, a color electrophotographic printer and includes four process cartridges or image formation units 11*a*, 11*b*, 11*c*, and 11*d* configured to form images of black, yellow, magenta, and cyan, respectively. Image formation units 11 (11*a*, 11*b*, 11*c*, and 11*d*) are provided in a line in that order (from the right side to the left side in FIG. 1) from the upstream to the downstream of conveyance path 21 for recording medium 20.

Image formation units 11*a* to 11*d* have the same configuration except for colors of toner (serving as developer) to be used therein, and thus image formation units 11*a* to 11*d* may be described as image formation units 11 hereinafter. Each image formation unit 11 (11*a* to 11*d*) includes photosensitive drum 14, serving as an image carrier, configured to rotate in a direction (a clockwise direction in FIG. 1). The detail configuration of each image formation unit 11 (11*a* to 11*d*) will be described later. LED (Light Emitting Diode) head 13, serving as an exposure device, is provided above each image formation unit 11. Each LED head 13 is configured to emit light to the surface of photosensitive drum 14 of image formation unit 11 thereby forming an electrostatic latent image on the surface of photosensitive drum 14.

Toner cartridges 12 (serving as developer containers) containing therein the respective colors are detachably attached to image formation units 11, respectively. Toner cartridges 12 have the same configuration and are configured to supply the respective color toners to the image formation units 11, respectively.

Provided under image formation apparatus 10 are: paper cassette 31 (medium cassette) capable of containing recording media 20 (for example, print paper) stacked therein; and feed roller 32 or a pickup roller configured to sequentially feed recording medium 20 one by one from stacked recording media 20. Feed roller 32 rotates to feed recording media 20 one by one to conveyance path 21. Provided along conveyance path 21 are conveyance roller pair 33 and conveyance roller pair 34 configured to correct a skew of recording medium 20 and convey recording medium 20 to the image formation units 11 (11*a* to 11*d*).

Transfer belt unit 35, serving as an image transfer unit or a conveyance-transfer unit, is provided under the image formation units 11 (11*a* to 11*d*). Transfer belt unit 35 is configured to convey recording medium 20 (medium) and transfer toner images (developer images) from photosensitive drums 14 to recording medium 20. Transfer belt unit 35 includes transfer belt 36 (e.g. an endless belt) having an lower line and an upper line on which recording medium 20 is to be attached and conveyed along a line of the image formation units 11 (11*a* to 11*d*). Transfer belt 36 is wound around and stretched between drive roller 36*a* and driven roller 36*b* and moves by means of the rotation of drive roller 36*a*. Transfer rollers 37 are provided facing photosensitive drums 14, respectively, such that the upper line of transfer belt 36 is sandwiched between photosensitive drums 14 and transfer rollers 37. A voltage is applied to each transfer roller 37 to create an electric field between transfer roller 37 and photosensitive drum 14. By means of the electric field caused by the voltage, the respective color images on photosensitive drums 14 are transferred to recording medium 20.

In the embodiment, transfer belt unit 35 (serving as the image transfer unit) is configured to convey recording medium 20, in the horizontal plane (in conveyance plane CP shown in FIG. 2), through the image formation units 11 (11*a* to 11*d*). However, conveyance plane CP to convey recording medium 20 is not limited to the horizontal plane but may be inclined with respect to the horizontal plane.

Fixation unit 41 is provided downstream of image formation units 11 (11*a* to 11*d*) in the conveyance direction of recording medium 20. Fixation unit 41 includes heat roller 41*a* and backup roller 41*b*. Fixation unit 41 is configured to apply pressure and heat to the toner image attached to recording medium 20, thereby fixing the toner image to recording medium 20. Provided downstream of fixation unit 41 in the conveyance direction of recording medium 20 are discharge roller pair 42 and discharge roller pair 43. Discharge roller pair 42 and discharge roller pair 43 are configured to discharge recording media 20 from fixation unit 41 through conveyance path 21 to stacker 44 (a medium discharge cassette) on the top of image formation apparatus 10, thereby discharged recording media 20 are stacked on stacker 44.

Next, the configuration of image formation unit 11 will be described in detail.

Figure 2:
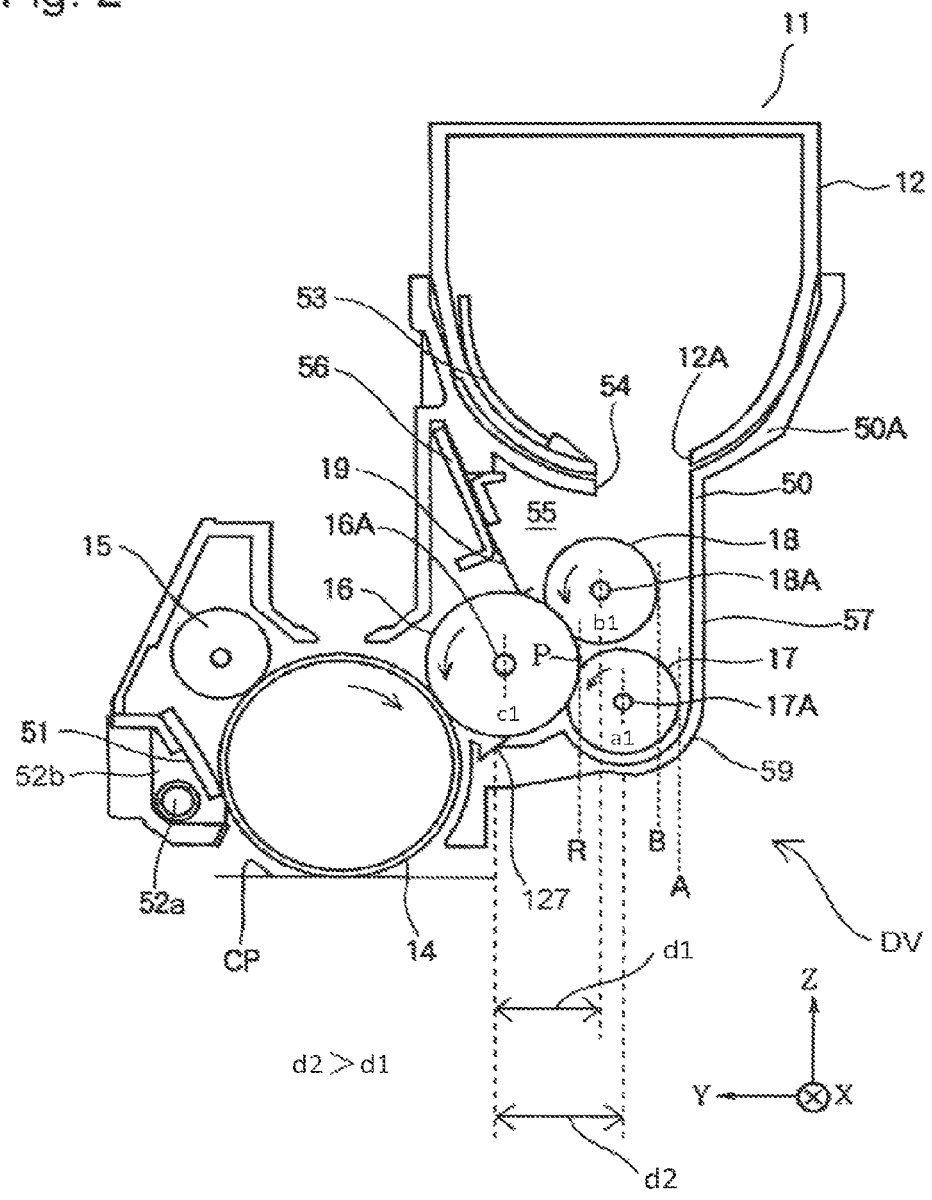
FIG. 2 is a sectional view of an image formation unit of the first embodiment of the invention.

FIG. 2 is a sectional view of image formation unit 11 of the first embodiment. Provided around photosensitive drum 14 in image formation unit 11 are: charge roller 15; development roller 16; supply rollers 17 and 18; and regulation blade 19. Charge roller 15, serving as a charge member, is configured to charge the surface of photosensitive drum 14. Development roller 16, serving as a developer carrier, is configured to develop an electrostatic latent image on the surface of photosensitive drum 14, which is formed by lights emitted from LED head 13, with toner, thereby forming a toner image on the surface of photosensitive drum 14. Supply rollers 17 and 18, serving as developer supply members, are configured to supply toner to development roller 16. Regulation blade 19, serving as a developer regulation member or a developer layer formation member, is configured to regulate the thickness of the toner on the surface of development roller 16 to form a toner layer having a uniform thickness.

Photosensitive drum 14 includes a drum-shaped conductive member (for example, aluminum) and a photoconductive layer formed on the outer surface of the conductive member. Photosensitive drum 14 includes a drive gear at an end of its rotational shaft and is configured to be driven to rotate in a direction (clockwise direction in FIG. 2). Charge roller 15 includes a metal shaft and a conductive elastic member, such as epichlorohydrin, coating the surface of the metal shaft. Charge roller 15 is provided in contact with the surface of photosensitive drum 14. Charge roller 15 is driven by the rotation of photosensitive drum 14. A high voltage (a charging voltage) is applied to charge roller 15 after a start of the rotation of charge roller 15, so as to uniformly charge the surface of photosensitive drum 14.

Development roller 16 includes metal shaft 16A and a conductive elastic member, such as urethane, coating the surface of shaft 16A. Development roller 16 is disposed on the downstream side with respect to LED head 13 in the rotational direction of photosensitive drum 14 and is in contact with the surface of photosensitive drum 14. Development roller 16 includes a gear at an end of shaft 16A and is driven by the driving force transmitted from photosensitive drum 14 to rotate in a direction opposite to the rotational direction of photosensitive drum 14. When the rotation of development roller 16 starts, a high voltage is applied to development roller 16 to form an electric field between the surface of development roller 16 and the surface of photosensitive drum 14, so as to attach the toner to the electrostatic latent image on photosensitive drum 14.

Supply rollers 17 and 18 include: metal shafts 17A and 18A; and elastomeric foams, such as silicon, coating the surfaces of shafts 17A and 18A, respectively. Supply rollers 17 and 18 are disposed in contact with development roller 16. Supply rollers 17 and 18 are formed with gears at one ends of shafts 17A and 18A and are driven by the driving force transmitted from photosensitive drum 14 to rotate in the same direction as the rotational direction of development roller 16. Supply rollers 17 and 18 are operable to slide-contact with development roller 16 to triboelectrically-charge the toner and supply the toner to development roller 16.

Hereinafter, among two supply rollers 17 and 18, supply roller 17, which is in contact with development roller 16 at a position upstream from the other supply roller 18 in the rotational direction of development roller 16, is referred to as "first supply roller 17" or a first developer supply member, whereas supply roller 18, which is in contact with development roller 16 at a position downstream from the other supply roller 17 in the rotational direction of development roller 16, is referred to as "second supply roller 18" or a second developer supply member. Second supply roller 18 is provided between first supply roller 17 and regulation blade 19 in the rotation direction of development roller 16. First supply roller 17 is located lower than second supply roller 18 in the vertical direction.

Note that, although supply rollers 17 and 18 are in contact with development roller 16 in the embodiment, supply rollers 17 and 18 may be spaced away from development roller 16 if the toner is adequately supplied to development roller 16 with an electrostatic force or the like.

Regulation blade 19 is, for example, an elastic blade made of a stainless-steel thin plate. Regulation blade 19 extends and has its length in the axial direction of development roller 16. One of widthwise ends of regulation blade 19 is fixed to holder 56 attached to and provided in frame 50 of image formation unit 11, while the other widthwise end of regulation blade 19 is provided in press-contact with the surface of development roller 16. Regulation blade 19 triboelectrically-charges the toner attached on the surface of development roller 16 while regulating the thickness of the toner to form a thin layer of the toner.

Cleaning blade 51 is, for example, an elastic blade made of urethane. Cleaning blade 51 extends and has its length in the axial direction of photosensitive drum 14. One of widthwise ends of cleaning blade 51 is provided in press-contact with the surface of photosensitive drum 14, so that cleaning blade 51 scrapes off and removes the toner that have remained on photosensitive drum 14 after transfer of the toner image. A waste toner conveyance mechanism or waste toner conveyance spiral 52*a* is provided under cleaning blade 51. Waste toner conveyance spiral 52*a* is configured to convey the toner that is removed by cleaning blade 51 to waste toner box 52*b* provided inside or outside of image formation unit 11.

Toner cartridge 12 is detachably attached to image formation unit 11. Toner cartridge 12 serves a developer container to contain therein the toner to be supplied (replenished) to image formation unit 11. Toner cartridge 12 is formed, at the bottom thereof, with toner supply port 12A and shutter 53 to open and close toner supply port 12A.

Frame 50 of image formation unit 11 functions as a housing accommodating development roller 16, supply rollers 17 and 18, and regulation blade 19 therein. Frame 50 of image formation unit 11 is formed, at an upper portion thereof, with cartridge attachment part 50A to which toner cartridge 12 is to be attached. Cartridge attachment part 50A is formed with toner filler port 54 or a toner reception port (developer reception port) at a location corresponding to toner supply port 12A of toner cartridge 12. In frame 50, an area that is formed, or defined (surrounded), by development roller 16, first supply roller 17, second supply roller 18, regulation blade 19, and frame 50 is referred to as a toner hopper or a toner container part 55 (developer hopper or developer container part). Toner container part 55 retains or accommodates therein the toner that is supplied from toner filler port 54. Note that a unit that includes: a toner container part 55; development roller 16; and supply rollers 17 and 18 may be referred as to a development unit (development device) DV, which develops the electrostatic latent image on photosensitive drum 14 with the toner (developer) thereby forming a toner image (a developer image) on photosensitive drum 14.

Frame 50 includes first wall portion 57 extending in a Z-direction (the vertical direction). The toner from toner filler port 54 into toner container part 55 mostly moves along first wall portion 57 in a downward direction (the Z direction). Frame 50 also includes second wall portion 59 beneath first wall portion 57. Second wall portion 59 faces first supply roller 17 and extends along the outer circumferential surface of first supply roller 17, so that the toner in the lower portion of toner container part 55 can be easily attached to first supply roller 17 that rotates.

In the state where toner cartridge 12 is attached to image formation unit 11 and toner supply port 12A of toner cartridge 12 is opened with shutter 53, the toner in toner cartridge 12 is supplied through toner filler port 54 to the inside of image formation unit 11, that is, to toner container part 55. The toner in toner container part 55 is supplied to development roller 16 by first and second supply rollers 17 and 18, regulated by regulation blade 19 to be a toner layer, and then attached to photosensitive drum 14 from development roller 16. This develops an electrostatic latent image on the surface of photosensitive drum 14 with the toner, to form a toner image.

In image formation unit 11 having the above configuration, the outer diameter of photosensitive drum 14 is 30 [mm], the outer diameter of development roller 16 is 20 [mm], the outer diameters of first and second supply rollers 17 and 18 are 15 [mm], in the first embodiment.

First supply roller 17 and second supply roller 18 are disposed such that they are pressed into development roller 16 by the amount (nip amount) of 1 mm. First and second supply rollers 17 and 18 are disposed such that the outer circumferential surface of first supply roller 17 protrudes out further (toward first wall portion 57 of frame 50) than the outer circumferential surface of second supply roller 18, in the state where image formation unit 11 is attached to image formation apparatus 10, as described below.

Figure 3:
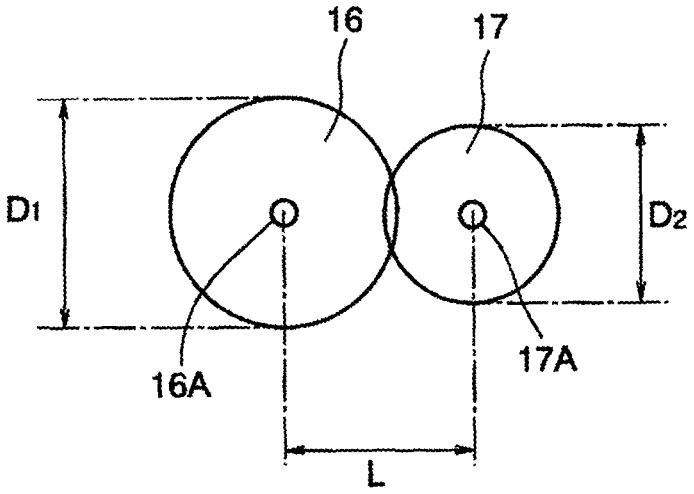
FIG. 3 is a schematic view for explaining a method of measurement of a nip amount between a supply roller and a developer roller.

Note that, as schematically illustrated in FIG. 3, the nip amount (N) between first supply roller 17 and development roller 16 (the amount of pressing first supply roller 17 into development roller 16) is obtained by the following expression, where the outer diameter of development roller 16 is referred to as D1, the outer diameter of first supply roller 17 is referred to as D2, and a distance between the axis of shaft 16A of development roller 16 and the axis of shaft 17A of first supply roller 17 is referred to as L.

$$N=\{(D1+D2)/2\}-L$$

Note that the nip amount between second supply roller 18 and development roller 16 (the amount of pressing second supply roller 18 into development roller 16) is also obtained likewise.

In the state where image formation unit 11 shown in FIG. 2 is attached to the body of image formation apparatus 10, the axial direction of photosensitive drum 14 (that is, the axial direction of development roller 16) is referred to as direction X, whereas a conveyance direction of recording medium 20 (a movement direction of recording medium 20) when recording medium 20 is conveyed in contact with photosensitive drum 14 is referred to as direction Y. A direction orthogonal to the XY plane is referred to as a Z direction. Accordingly, in this embodiment, the XY plane is parallel to conveyance plane CP. Although the XY plane is the horizontal plane and the Z direction is the vertical direction in the embodiment, the invention is not limited to that.

Referring to FIG. 2, one of tangent lines, extending in the Z direction, to the outer circumferential surface of first supply roller 17 that is away from (across from) development roller 16 (the contact between development roller 16 and first supply roller 17) is referred to as "tangent line A". In other words, there are two tangent lines, parallel to the Z direction, to the outer circumferential surface of first supply roller 17. One of the tangent lines that is not close to, and is away from, development roller 16 is referred to as "tangent line A". Also, one of tangent lines, extending in the Z direction, to the outer circumferential surface of second supply roller 18 that is away from development roller 16 is referred to as "tangent line B". In other words, there are two tangent lines, parallel to the Z direction, to the outer circumferential surface of second supply roller 18. One of the tangent lines that is not close to, and is away from, development roller 16 is referred to as "tangent line B". Further, one of tangent lines, extending in the Z direction, to the outer circumferential surface of development roller 16 that is close to the supply rollers 17 and 18 is referred to as "tangent line R". In other words, there are tangent lines, parallel to the Z direction, to the outer circumferential surface of development roller 16. One of the tangent lines that is provided at a near side to the supply rollers 17 and 18 is referred to as "tangent line R".

In the first embodiment, rollers 16, 17, and 18 are disposed such that a distance between tangent line R of development roller 16 and tangent line A of first supply roller is longer than a distance between tangent line R of development roller 16 and tangent line B of second supply roller 18.

In other words, supply rollers 17 and 18 are disposed such that first supply roller 17, which is provided lower than second supply roller 18 in the Z direction (the movement direction of the toner by gravity), protrudes out further (toward the opposite side of tangent line R) than second supply roller 18. That is, the outer circumference of first supply roller 17 is located such that the toner in toner container part 55 moving (downward) along the Z direction can easily reach to the outer circumference of first supply roller 17.

Since the outer diameters of supply rollers 17 and 18 are the same in the first embodiment, rollers 16, 17, and 18 are disposed in a way that a distance from contact point P (point of tangency) where tangent line R contacts the outer circumference of development roller 16, to the contact (the nip) between development roller 16 and first supply roller 17, is shorter than a distance from contact point P to the contact (the nip) between development roller 16 and second supply roller 18.

With this layout, first supply roller 17 protrudes outside more than second supply roller 18, even in the case where the outer diameters of supply rollers 17 and 18 are the same.

Note that, a distance (d1) between line c1 to line b1 is shorter than a distance (d2) between line c1 and line a1, where: a line that passes through the center of shaft 17A of supply roller 17 and is parallel to the Z direction is referred to as "line a1"; a line that passes through the center of shaft 18A of supply roller 18 and is parallel to the Z direction is referred to as "line b1"; and a line that passes through the center of shaft 16A of development roller 16 and is parallel to the Z direction is referred to as "line c1".

It is preferable that tangent line A of first supply roller 17 and tangent line B of second supply roller 18 is provided within toner filler port 54 in the Y direction (that is, provided between both ends of toner filler port 54 in the Y direction) (as seen along the Z direction). With this structure, toner that moves downward from toner filler port 54 in the Z direction can easily reach the surface of first supply roller 17 and the surface of second supply roller 18.

The rotation directions of development roller 16 and supply rollers 17 and 18 are as follows. The rotation direction of development roller 16 is a counter-clockwise direction in FIG. 2, that is, a direction opposite to the rotation direction of photosensitive drum 14. Thus, at a contact (a nip) between development roller 16 and photosensitive drum 14, the direction of the circumferential movement of photosensitive drum 14 is the same as the direction of the circumferential movement of development roller 16.

The rotation direction of each supply roller 17 and 18 is a counter-clockwise direction in FIG. 2, that is, the same direction as the rotation direction of development roller 16. Thus, at the contact between first supply roller 17 and development roller 16, the direction of the circumferential movement of first supply roller 17 is opposed to the direction of the circumferential movement of development roller 16. Likewise, at the contact between second supply roller 18 and development roller 16, the direction of the circumferential movement of second supply roller 18 is opposed to the direction of the circumferential movement of development roller 16. This configuration can mechanically remove (scrape) toner that is attached to supply rollers 17 and 18 and attaches the toner to development roller 16. This prevents the toner from staying on the surfaces of supply rollers 17 and 18, and thus prevents excessively-charged toner.

Note that it should be appreciated that the rotational directions of supply rollers 17 and 18 are not limited to the above configuration. For example, the rotational directions of supply rollers 17 and 18 may be set, depending on properties of the toner and supply rollers 17 and 18 or the like, so as to effectively transfer the toner from supply rollers 17 and 18 to development roller 16.

In the embodiment, circumferential speeds of development roller 16, first supply roller 17, and second supply roller 18 are, for example, 200 [mm/second], 160 [mm/second], and 160 [mm/second], respectively. Voltages applied to development roller 16, first supply roller 17, and second supply roller 18 are, for example, −200 [V], −300 [V], and −300 [V], respectively.

The relationship between the voltage applied to development roller 16 and the voltages applied to supply rollers 17 and 18 may be different from the first embodiment, if the relationship is satisfied to generate electric fields between development roller 16 and supply rollers 17 and 18 causing the triboelectrically charged toner to be electrostatically transferred to development roller 16 from first and second supply rollers 17 and 18. For example, in the case where the toner in use is negatively-charged toner and the applied voltages are negative, the applied voltages may be any values if absolute values of the applied voltages to first and second supply rollers 17 and 18 are greater than an absolute value of the applied voltage to development roller 16. The applied voltages to first supply roller 17 and second supply roller 18 are not necessarily the same and may be different from each other.

Figure 4:
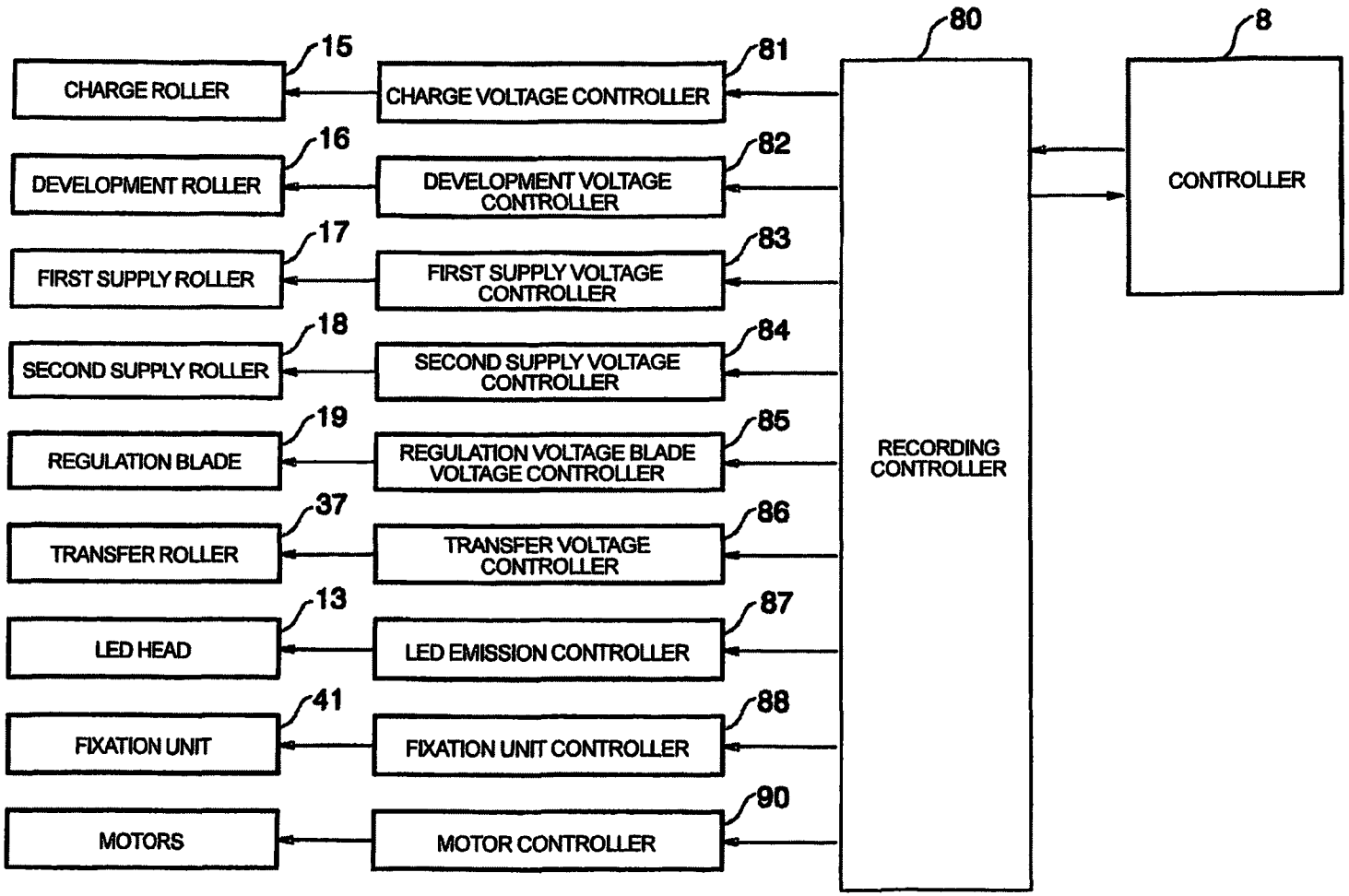
FIG. 4 is a block diagram illustrating a control system of the image formation apparatus of the first embodiment of the invention.

Next, a control system of image formation apparatus 10 will be described. FIG. 4 is a block diagram of the control system of image formation apparatus 10.

As show in FIG. 4, recording control unit 80 provided in image formation apparatus 10 controls: charging voltage controller 81 configured to apply a charging voltage to charge roller 15 of each image formation unit 11; development voltage controller 82 configured to apply a development voltage to development roller 16; first supply voltage controller 83 configured to apply a supply voltage to first supply roller 17; second supply voltage controller 84 configured to apply a supply voltage to second supply roller 18; regulation blade voltage controller 85 configured to apply a regulation blade voltage to regulation blade 19; and transfer voltage controller 86 configured to apply a transfer voltage to transfer rollers 37.

Recording control unit 80 also controls: emission controller 87 configured to control LED head 13 to emit light in accordance with inputted image data; and fixation unit controller 88 configured to control the heater of fixation unit 41. Further, recording control unit 80 controls motor controller 90 configured to perform drive control of: a motor that rotates photosensitive drum 14 of each image formation unit 11; a motor that rotates feed roller 32 configured to feed and convey recording medium 20; a motor that rotates conveyance roller pair 33 and conveyance roller pair 34; and a motor that rotates transfer rollers 37, discharge roller pairs 42 and 43.

Recording control unit 80 is controlled by controller 8 that controls the entire system of image formation apparatus 10.

Next, operation of image formation apparatus 10 will be described with reference to FIGS. 1, 2, and 4.

Upon receiving image data transmitted from an external apparatus (for example, a personal computer), controller 8 of image formation apparatus 10 transmit the image data to recording control unit 80 via an image process circuit provided in controller 8. Recording control unit 80 controls motor controller 90 to rotate rotating feed roller 32, conveyance roller pairs 33 and 34, and the like to start feeding and conveying recording medium 20, and transmits the image data to LED emission controller 87. At the times when recording medium 20 reaches image formation units 11, voltage controllers 81 to 86 apply the voltages to charge roller 15, development roller 16, supply rollers 17 and 18, regulation blade 19, and transfer rollers 37, respectively, and LED emission controller 87 makes LED head 13 emit lights in accordance with the image data. With this operation, an electrostatic latent image is formed on the surface of photosensitive drum 14 of each image formation unit 11.

In each image formation unit 11, as shown in FIG. 2, toner that is supplied from toner cartridge 12 through toner filler port 54 is accommodated in toner container part 55 in frame 50. The toner in toner container part 55 is supplied to development roller 16 with first supply roller 17 and second supply roller 18. The toner on development roller 16 is regulated by regulation blade 19 to be a thin toner layer and then supplied to photosensitive drum 14. Accordingly, the electrostatic latent image on the surface of photosensitive drum 14 is developed with the toner, thereby forming a toner image on the surface of photosensitive drum 14.

The toner image on the surface of photosensitive drum 14 is transferred to recording medium 20 on transfer belt 36, at a position between photosensitive drum 14 and transfer rollers 37, by means of a potential difference between photosensitive drum 14 and transfer rollers 37. That is, while recording medium 20 passes through the image formation units 11*a* to 11*d*, toner images of four colors are transferred to recording medium 20.

Recording medium 20 having the multi-color toner image attached thereon is conveyed to fixation unit 41 by means of transfer belt 36, and then is fused to be fixed to recording medium 20 by heat and pressure in fixation unit 41. Recording medium 20 having the toner image fixed thereon is discharged out of image formation apparatus 10 by discharge roller pairs 42 and 43 and stacked on stacker 44. Accordingly, an image formation process wherein an image is formed on the surface of recording medium 20 is completed.

Figure 5:
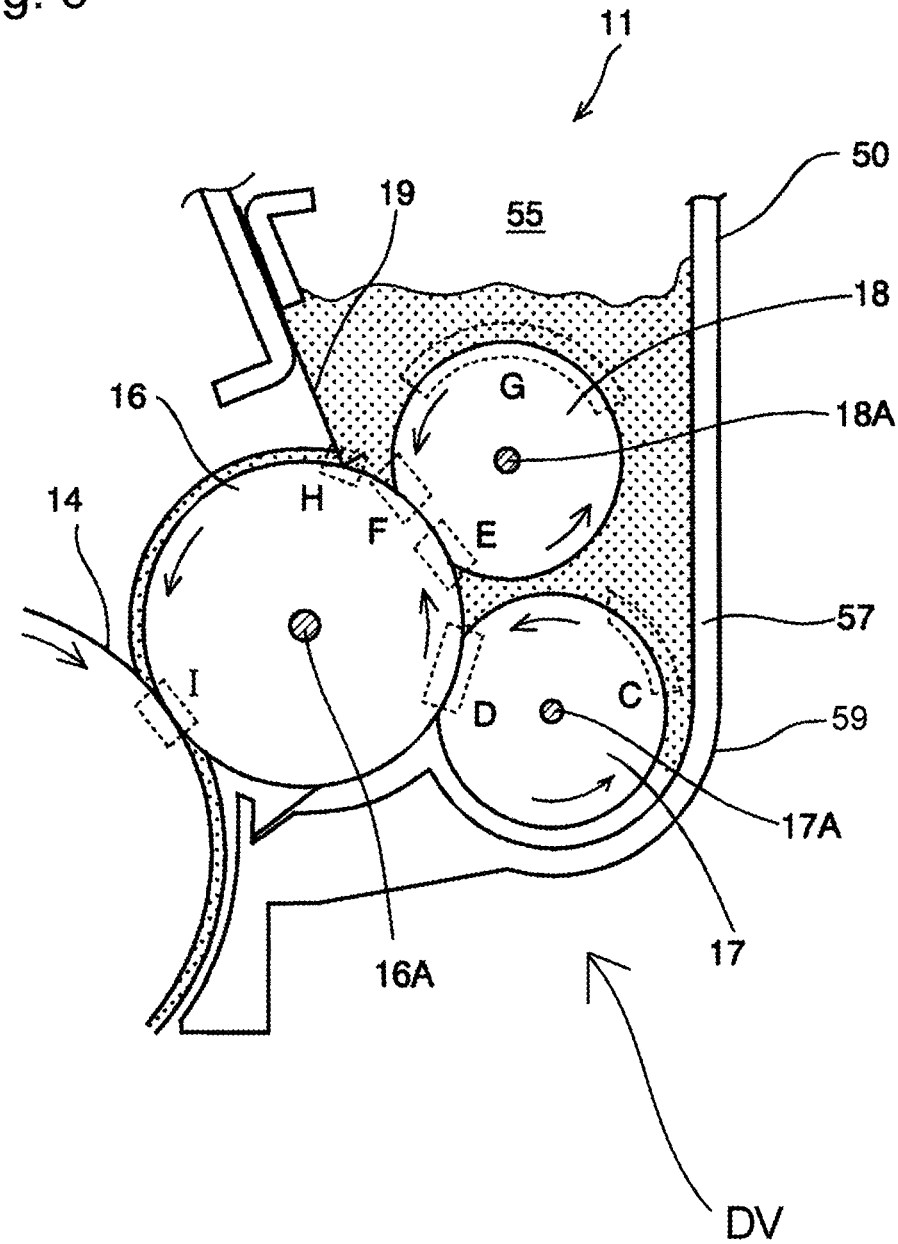
FIG. 5 is a diagrammatic view illustrating a flow of toner in the image formation unit according to the first embodiment of the invention.

FIG. 5 is a diagrammatic view illustrating a flow of toner in the image formation unit in a continuous printing of a solid pattern, for example. The toner supplied from toner cartridge 12 moves, in toner container part 55 of image formation unit 11, downward (vertically downward) along first wall portion 57 of frame 50, and then is deposited mainly on upper portions of the outer circumferences of first supply roller 17 and second supply roller 18. Then, toner that is attached to area C of the outer circumference of first supply roller 17 is transferred by the rotation of first supply roller 17 and reaches area D, which is a contact area between first supply roller 17 and development roller 16.

The toner that reaches area D is triboelectrically charged by friction between the toner and development roller 16 and thus electrostatically attached to the surface of development roller 16. The toner is conveyed by the rotation of development roller 16, and reaches to area E, which is an entrance area of the contact between development roller 16 and second supply roller 18.

A part of the toner that reaches area E is attached to the surface of second supply roller 18 and is mostly conveyed by the rotation of second supply roller 18. On the other hand, toner that is not attached to second supply roller 18 and stays on development roller 16 passes through the contact between development roller 16 and second supply roller 18.

At area F, which is an exit area of the contact between development roller 16 and second supply roller 18, the following three toners join together: toner that has passed through the contact between development roller 16 and second supply roller 18; toner that has attached to and is conveyed by first supply roller 17, development roller 16, and second supply roller 18 in that order and has been conveyed to area F; and toner that has attached to area G, which is an upper portion of the outer circumference of second supply roller 18 and has been conveyed by second supply roller 18 to area F. The joined toner is triboelectrically charged by the friction between the toner and development roller 16 and thus electrostatically attached to development roller 16. The toner is conveyed by development roller 16 to area H, which is a contact between regulation blade 19 and development roller 16.

The toner that reaches area H is triboelectrically-charged by development roller 16 and regulation blade 19 and is regulated by development roller 16 to be a toner layer of a constant thickness. The toner layer is conveyed by the rotation of development roller 16 and then reaches area I, which is a contact area between development roller 16 and photosensitive drum 14. The toner that reaches area I is attached to the electrostatic latent image on the surface of photosensitive drum 14, to develop the electrostatic latent image with the toner.

In the case of executing a continuous printing of a solid pattern, almost all toner that is attached on development roller 16 are consumed in the process of developing the electrostatic latent image by being attached to photosensitive drum 14. However, in the first embodiment, first supply roller 17 conveys much toner to the contact (area E) between development roller 16 and second supply roller 18. This increases the amount of toner that is attached to and conveyed by development roller 16 and the amount of toner that is attached to and conveyed by second supply roller 18. Further, in the first embodiment, since the outer circumference of first supply roller 17 protrudes further out than the outer circumference of second supply roller 18, the toner that moves downward in the Z direction in toner container part 55 can easily reach to first supply roller 17 as a lower roller, as well as second supply roller 18 as an upper roller. Therefore, the first embodiment can supply much more toner to development roller 16 by supply rollers 17 and 18.

Next, experiment results using image formation unit 11 of the first embodiment will be described. In the experiment, a "toner supply amount" is measured under different conditions wherein a ratio of circumferential velocity of supply rollers 17 and 18 to that of development roller 16 is changed.

Figure 6A:
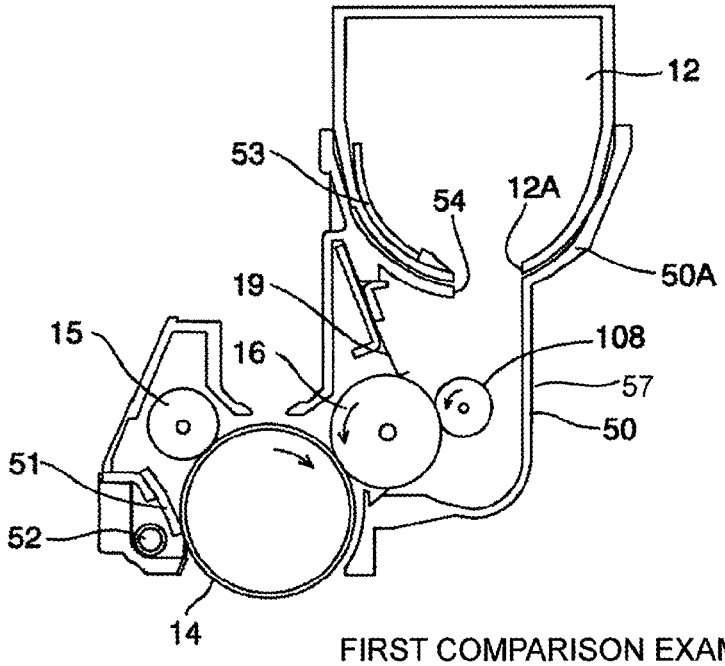
FIGS. 6A and 6B are views illustrating a first comparison example and a second comparison example to be compared with the image formation unit of the first embodiment of the invention.
Figure 6B:
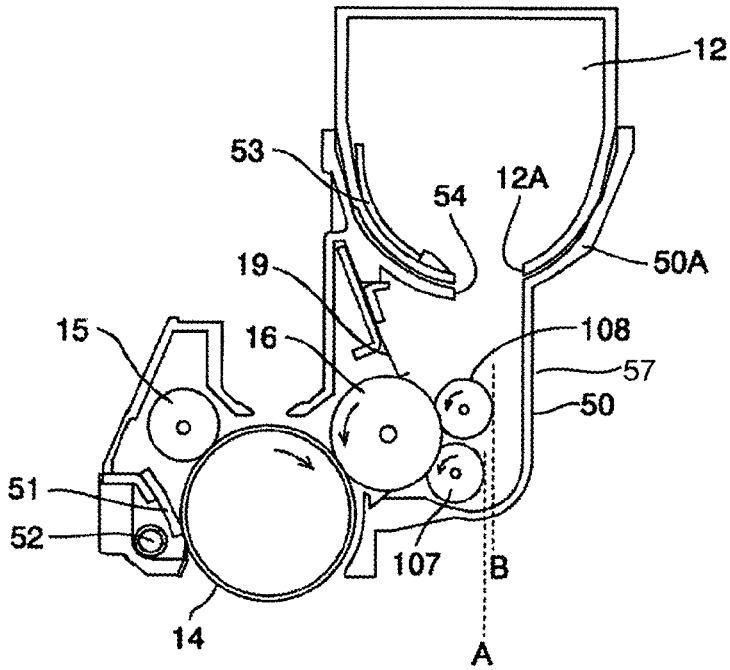

Experiments are executed by using a first comparison example shown in FIG. 6A and a second comparison example shown in FIG. 6B with respect to the image formation unit of the first embodiment. FIG. 6A shows an image formation unit of the first comparison example having only one supply roller (first supply roller 108). The image formation unit of the first comparison example has the same structure as that of the first embodiment except for having only one supply roller (first supply roller 108).

FIG. 6B shows an image formation unit of the second comparison example. The image formation unit of the second comparison example shown in FIG. 6B has two supply rollers 107 and 108 in contact with development roller 16, wherein second supply roller 108 is provided above the first supply roller 107 in the Z direction (the vertical direction). The outer circumference of second supply roller 108 protrudes outside more than the outer circumference of first supply roller 107 (in the direction away from development roller 16). That is, the outer circumference of second supply roller 108 protrudes out from tangent line A, along the vertical direction, to the outer circumference of first supply roller 107. The other configuration of the image formation unit of the second comparison example is the same as that of the image formation unit of the first embodiment.

Figure 7:
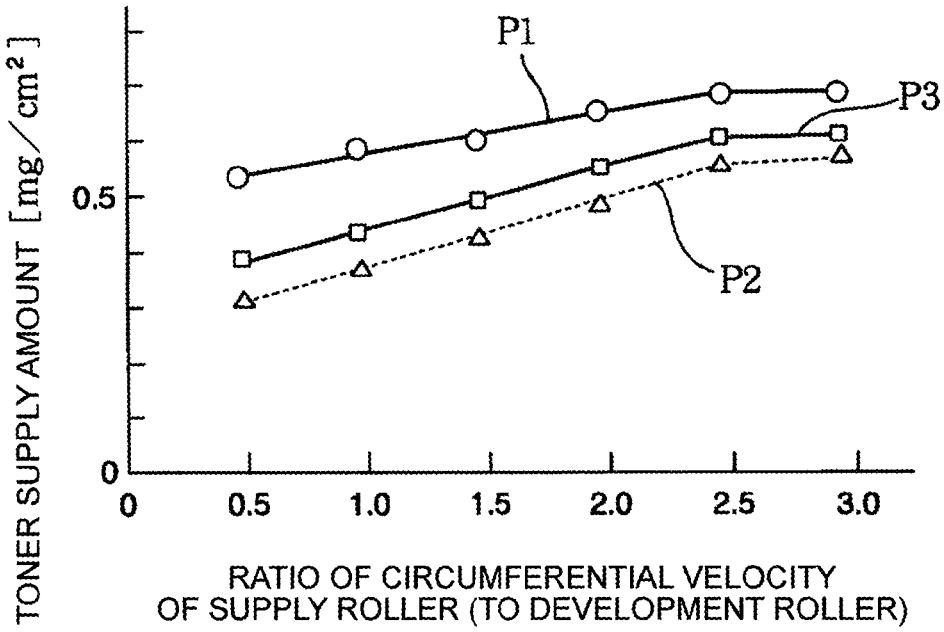
FIG. 7 is a graph illustrating a relationship between an amount of toner supplied to the development roller and a ratio of circumferential velocity of the supply rollers to that of the development roller.

FIG. 7 is a graph illustrating the relationship between the "toner supply amount" to the development roller and a ratio of circumferential velocity of supply rollers to the development roller, illustrating variation of the "toner supply amount" in the case of changing the ratio from 0.5 to 3.0.

In the experiments, after a continuous printing of a slide pattern or a solid image, an amount of toner that is attached to the surface of development roller 16 is measured. The measured toner amount is referred to as the "toner supply amount" to development roller 16. In FIG. 7, the vertical axis indicates the toner supply amount to the development roller, and the horizontal axis indicates the ratio of the circumferential velocity of the supply rollers to that of the development roller. Note that circumferential velocities of supply rollers 17 and 18 (and supply rollers 107 and 108) are the same.

In FIG. 7, plot P1 indicates an experiment result on image formation unit 11 of the first embodiment, plot P2 indicates an experiment result on the image formation unit of the first comparison example (FIG. 6A), and plot P3 indicates an experiment result on the image formation unit (FIG. 6B) of the second comparison example.

As shown in FIG. 7, the "toner supply amount" (plot P3) to the development roller in the second comparison example having two supply rollers is greater than that of the first comparison example (plot P2) having only one supply roller. However, the difference in the "toner supply amount" is relatively small.

In contrast, the "toner supply amount" to the development roller in the first embodiment (plot P1) is much greater than the first comparison example (plot P2) and the second comparison example (plot P3). For example, the "toner supply amount" where the ratio of circumferential velocity of the supply rollers to that of the development roller is 0.8 in the first embodiment (plot P1) is the same as where the ratio of circumferential velocity of the supply rollers to that of the development roller is 3.0 in the first comparison example (plot P2).

It is assumed that the reason why the above described result is obtained is the following. The first embodiment has two supply rollers 17 and 18 such that the outer circumference of first supply roller 17, which is provided under second supply roller 18 in the Z direction (in a toner movement direction), protrudes further out than the outer circumference of second supply roller 18. With this structure, the toner moving downward along the Z direction in toner container part 55 can easily reach not only second supply roller 18 but also first supply roller 17 provided under second supply roller 18, as shown in FIG. 4. Therefore, it is assumed that sufficient amount of the toner is supplied to development roller 16 by supply rollers 17 and 18.

As described above, the first embodiment has two supply rollers 17 and 18 to supply the toner (developer) to development roller 16 wherein the outer circumference of first supply roller 17, which is provided beneath second supply roller 18 in the Z direction, protrudes further out than the outer circumference of second supply roller 18. Thus, the first embodiment can supply, to development roller 16, a sufficient amount of the toner to a continuous printing of a solid pattern. Accordingly, this stabilizes the image density, thereby maintaining the image quality high.

Further, the embodiment can set the ratio of circumferential velocity of the supply rollers 17 and 18 to that of the development roller 16 to be equal to or less than 1.0. Accordingly, the embodiment can reduce attritions of supply rollers 17 and 18 to lengthen the life of image formation unit 11.

In a case where the image formation apparatus is a tandem color printer having four image formation units 11*a* to 11*d* arranged in a line to complete a color print in a single passage of a sheet of paper and toner cartridges 12 are attached to the upper portions of the image formation units 11*a* to 11*d*, a small high image quality color printer is realized since a sufficient amount of the toner can be supplied to development roller 16 as described above.

Figure 8:
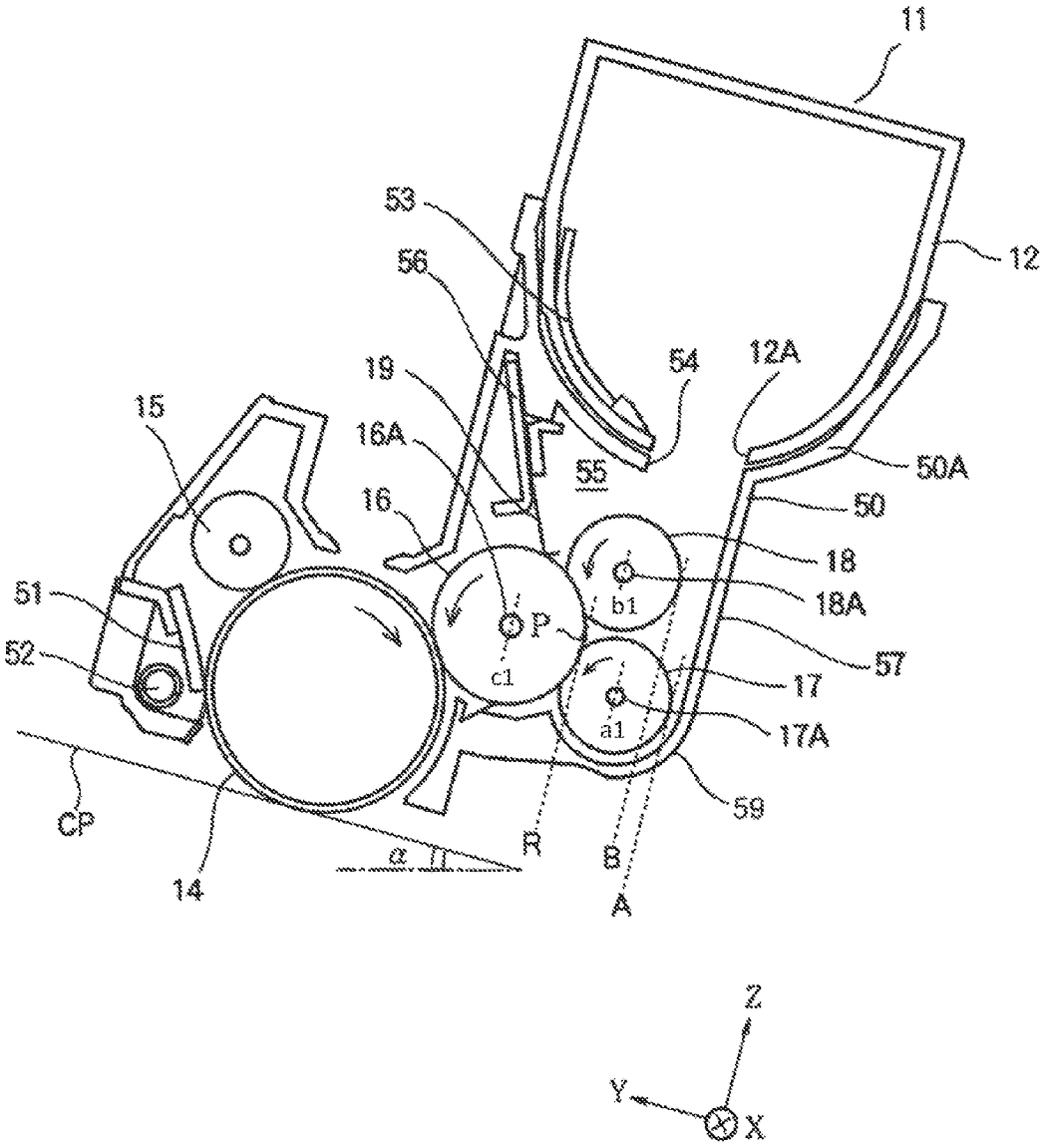
FIG. 8 is a sectional view of another configurational example of the image formation unit according to the first embodiment of the invention.

Note that, in the first embodiment, the description has been given wherein conveyance plane CP is the horizontal plane. However, as shown in FIG. 8, conveyance plane CP may be titled with respect to the horizontal plane. In the case where conveyance plane CP inclines with respect to the horizontal plane, it is preferable or required that rollers 16, 17, and 18 are disposed such that first supply roller 17 is provided closer to conveyance plane CP than second supply roller 18 in the direction (the Z direction) orthogonal to conveyance plane CP, and a distance from development roller 16 to tangent line A to the outer circumference of first supply roller 17 is greater than a distance from development roller 16 to tangent line B to the outer circumference of second supply roller 18 in the XY plane (that is, the plane parallel to conveyance plane CP). Also, it is preferable or required that toner container part 55 is provided away from conveyance plane CP in the direction (the Z direction) orthogonal to conveyance plane CP.

Note that the reason why conveyance plane CP is used as a reference is the following. In general, image formation units 11*a* to 11*d* are configured such that first wall portion 57 of frame 50 is disposed orthogonal to conveyance plane CP. The toner in toner container part 55 generally moves along first wall portion 57. That is, the direction of movement of the toner in toner container part 55 is basically parallel to first wall portion 57. Therefore, by arranging first supply roller 17, second supply roller 18, and development roller 16 in the above described manner, the amounts of toner that reach, not only the surface of first supply roller 17 but also the surface of second supply roller 18, are increased, thereby stabilizing the image density.

An agitation member or an agitation roller may be provided above supply rollers 17 and 18 in image formation unit 11 to agitate the toner in image formation unit 11. Also, the following modifications may be applied to the first embodiment.

[First Modification]

Figure 9:
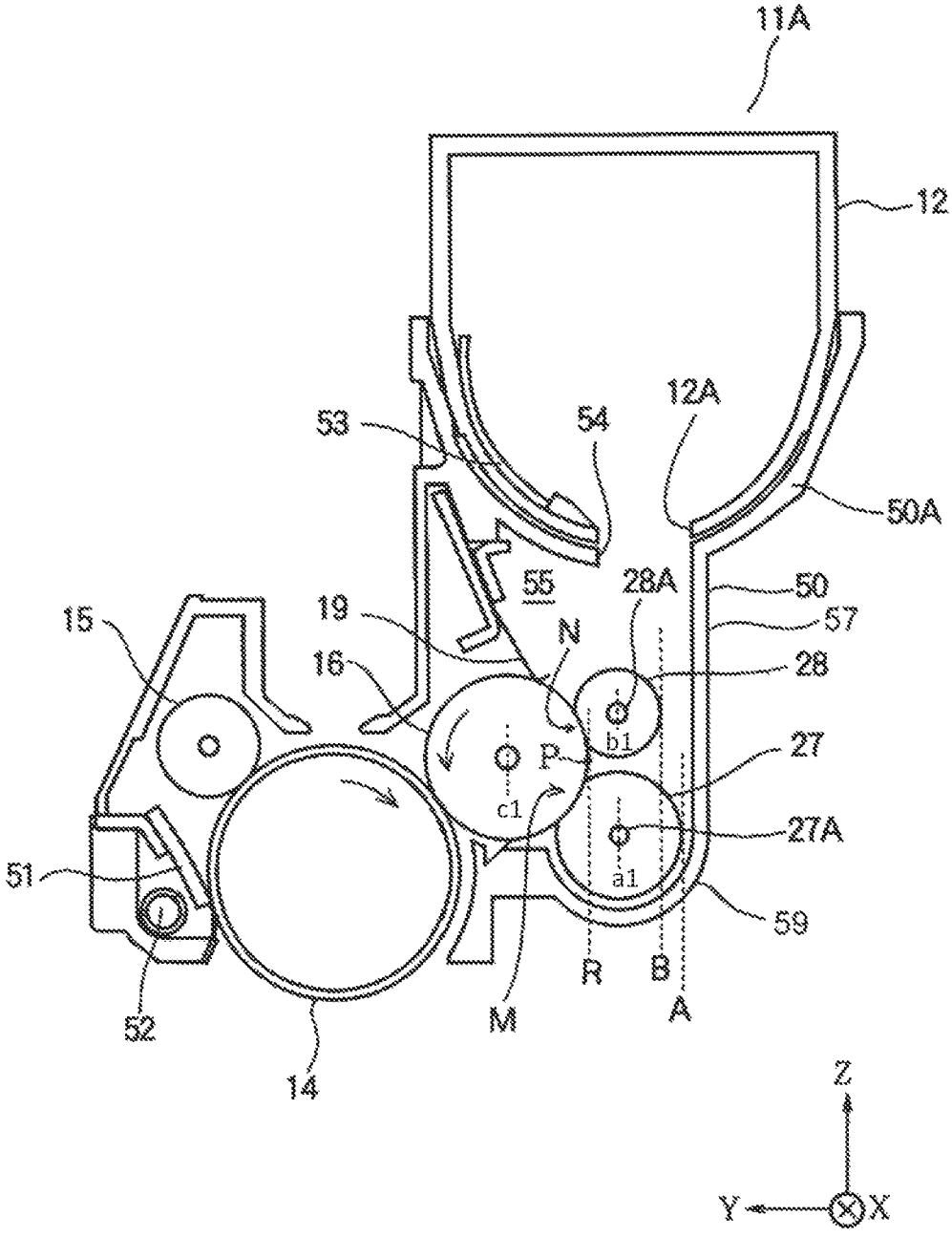
FIG. 9 is a sectional view of a first modification of the image formation unit of the first embodiment of the invention.

FIG. 9 is a sectional view of image formation unit 11A according to a first modification of the first embodiment. Image formation unit 11A according to the first modification shown in FIG. 9 has a configuration wherein the outer diameter and the layout of the supply rollers are different from image formation unit 11 (FIG. 2) according to the first embodiment.

In the first modification, the outer diameters of first supply roller 27 and second supply roller 28 are different from each other. Also, in the first modification, contact N between second supply roller 28 and development roller 16 is located closer to contact point P (point of tangency) where tangent line R contacts the outer circumference of development roller 16, than to contact M between first supply roller 27 and development roller 16. In the first modification, the outer diameter of first supply roller 27 is 16 [mm], and the outer diameter of second supply roller 28 is 11 [mm]. The outer diameter of development roller 16 is 20 [mm].

With this configuration, in the state where image formation unit 11 A is attached to image formation apparatus 10, a distance from tangent line R (that is, one of the tangent lines, extending in the Z direction, to the outer circumference of development roller 16) to tangent line A (that is, one of the tangent lines, extending in the Z direction, to the outer circumference of first supply roller 27 that is away from development roller 16) is greater than a distance from tangent line R to tangent line B (that is, one of the tangent lines, extending in the Z direction, to the outer circumference of second supply roller 28 that is away from development roller 16).

Therefore, among supply rollers 27 and 28 configured to supply the toner to development roller 16, first supply roller 27 is disposed protruding further out than second supply roller 28, which is provided above first supply roller 27 in the Z direction (the toner movement direction). That is, first supply roller 27, which is provided beneath second supply roller 28, is provided at a position where toner that is moving downward in the Z direction can easily reach.

Consequently, the first modification can supply a sufficient amount of the toner to development roller 16 in a continuous printing of a solid pattern or image, so as to stabilize the image density and thus to maintain the image quality.

Further, since the first modification has supply rollers 27 and 28 whose outer diameters are different from each other, there is no need to dispose first supply roller 27 and second supply roller 28 in such a structure (see, FIG. 2) that a distance from line c1 to line b1 is smaller than a distance from line c1 and line a1. Line c1 is parallel to the Z direction and passes through the center of shaft 16A of development roller 16. Line b1 is parallel to the Z direction and passes through the center of shaft 28A of second supply roller 28. Line a1 is parallel to the Z direction and passes through the center of shaft 27A of first supply roller 27. This brings about a relatively-high setting freedom of disposition of supply rollers 27 and 28.

[Second Modification]

Figure 10:
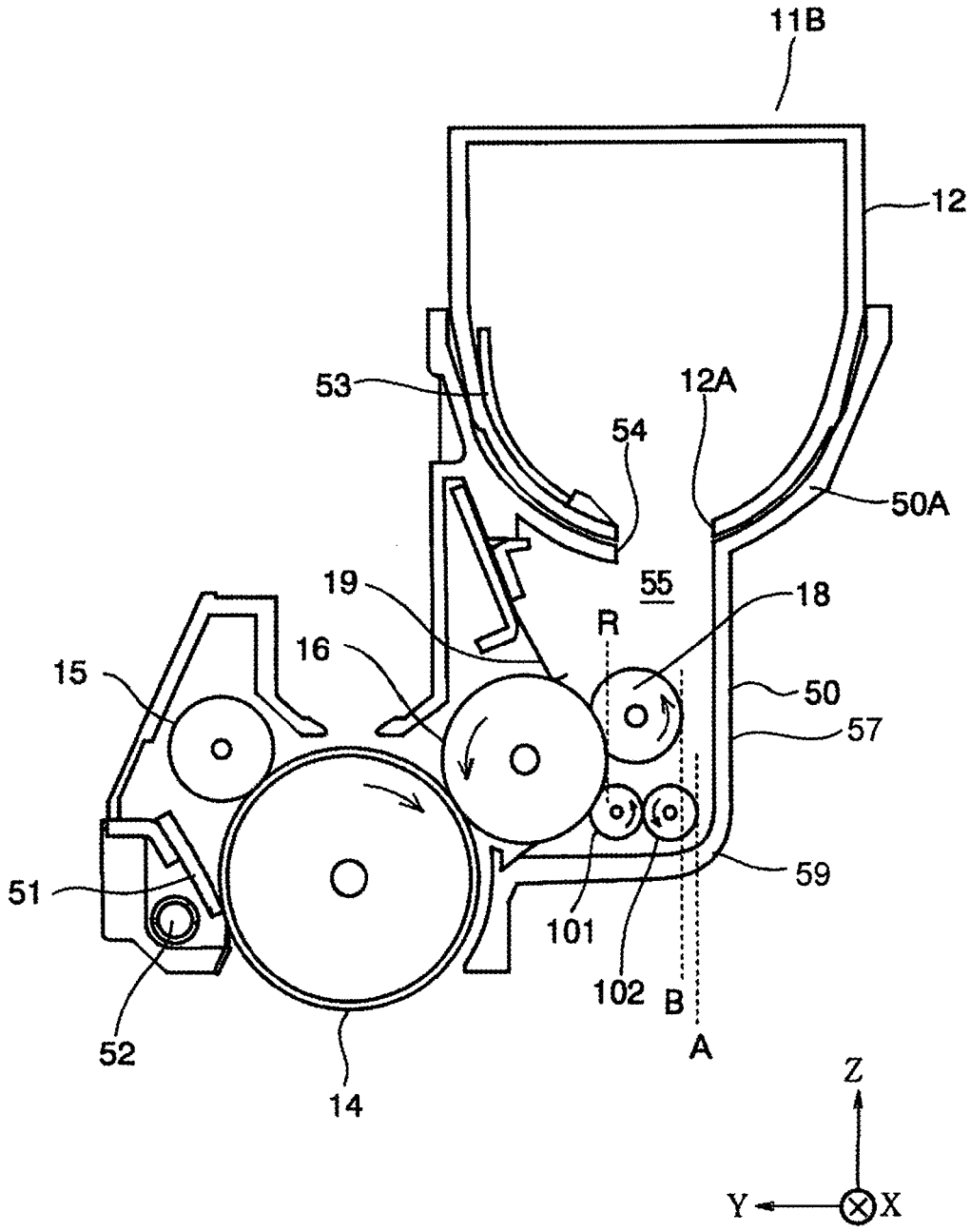
FIG. 10 is a sectional view of a second modification of the image formation unit of the first embodiment of the invention.

FIG. 10 illustrates image formation unit 11B according to a second modification of the first embodiment. Image formation unit 11B according to the second modification shown in FIG. 10 is provided with a pair of rollers 101 and 102, instead of first supply roller 17 of image formation unit 11 (FIG. 2) of the first embodiment.

First roller 101 is disposed in contact with the outer circumference (the surface) of development roller 16, while second roller 102 is disposed in contact with the outer circumference (the surface) of first roller 101. The rotation directions of rollers 101 and 102 are the same as the rotation direction of development roller 16. Therefore, at a contact area between development roller 16 and first roller 101, a circumferential movement direction of development roller 16 is opposite to a circumferential movement direction of first roller 101, while, at a contact area between second roller 102 and first roller 101, a circumferential movement direction of second roller 102 is opposite to the circumferential movement direction of first roller 101. Note that the outer diameters of first roller 101 and second roller 102 may be the same as, or different from, each other.

As shown in FIG. 10, in the state where image formation unit 11B is attached to image formation apparatus 10, rollers 16, 18, 101, and 102 are disposed such that a distance between tangent line A and tangent line R is greater than a distance between tangent line B and tangent line R, where tangent line A is one of the tangent lines, extending in the Z direction, to the outer circumference of second roller 102 that is away from development roller 16; tangent line B is one of the tangent lines, extending in the Z direction, to the outer circumference of second supply roller 18, that is away from development roller 16; and tangent line Z is a tangent line, extending in the Z direction, to the outer circumference of development roller 16.

With this configuration, one of rollers 101 and 102, which are disposed beneath second supply roller 18 in the Z direction (the toner movement direction), is disposed protruding outside more than second supply roller 18. That is, one of rollers 101 and 102 is provided at a position where toner that moves downward along the Z direction in toner container part 55 can easily reach. Therefore, the second modification also can supply a sufficient amount of the toner to development roller 16 in a continuous printing of a solid pattern or image, thereby stabilizing the image density to maintain the image quality.

[Third Modification]

Figure 11:
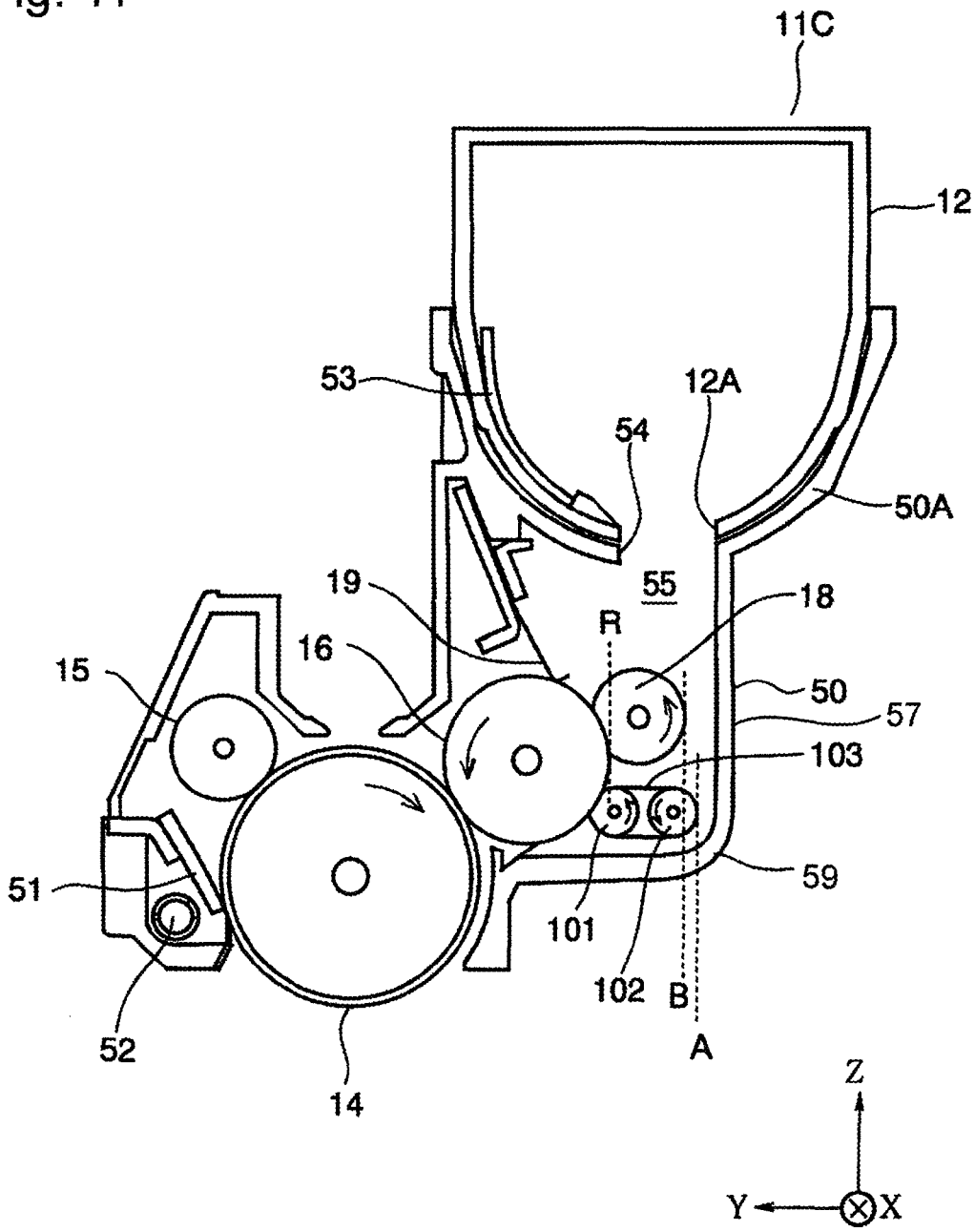
FIG. 11 is a sectional view of a third modification of the image formation unit of the first embodiment of the invention.

FIG. 11 is a view of image formation unit 11C according to a third modification of the first embodiment. Image formation unit 11C according to the third modification shown in FIG. 11 has a pair of rollers 101 and 102 and endless belt 103, instead of first supply roller 17 of image formation unit 11 (FIG. 2) of the first embodiment.

First roller 101 is disposed facing the surface of development roller 16, while first roller 101 and second roller 102 are parallely-disposed with a certain distance therebetween. Endless belt 103, which is wound around and stretched between rollers 101 and 102, is provided pressed against the outer circumference of development roller 16 by first roller 101. The rotation directions of rollers 101 and 102 are the same as each other and are also the same as the rotation direction of development roller 16. By the rotation of rollers 101 and 102, endless belt 103 rotationally moves around.

In the state where image formation unit 11C is attached to image formation apparatus 10, rollers 16, 18, 101, and 102 are disposed such that a distance between tangent line A and tangent line R is greater than a distance between tangent line B and tangent line R, where tangent line A is one of the tangent lines, extending in the Z direction, to the outer circumference of second roller 102 that is away from development roller 16; tangent line B is one of the tangent lines, extending in the Z direction, to the outer circumference of second supply roller 18, that is away from development roller 16; and tangent line Z is a tangent line, extending in the Z direction, to the outer circumference of development roller 16.

Like the second modification, in the third modification, one of rollers 101 and 102, which are disposed beneath second supply roller 18 in the Z direction (the toner movement direction), is disposed protruding outside more than second supply roller 18. That is, one of rollers 101 and 102 is provided at a position where the toner that moves downward along the Z direction in toner container part 55 can easily reach. Therefore, the third modification also can supply a sufficient amount of toner to development roller 16 in a continuous printing of a solid pattern or image, thereby stabilizing the image density to maintain the image quality.

《2》 [Second Embodiment]

Figure 12:
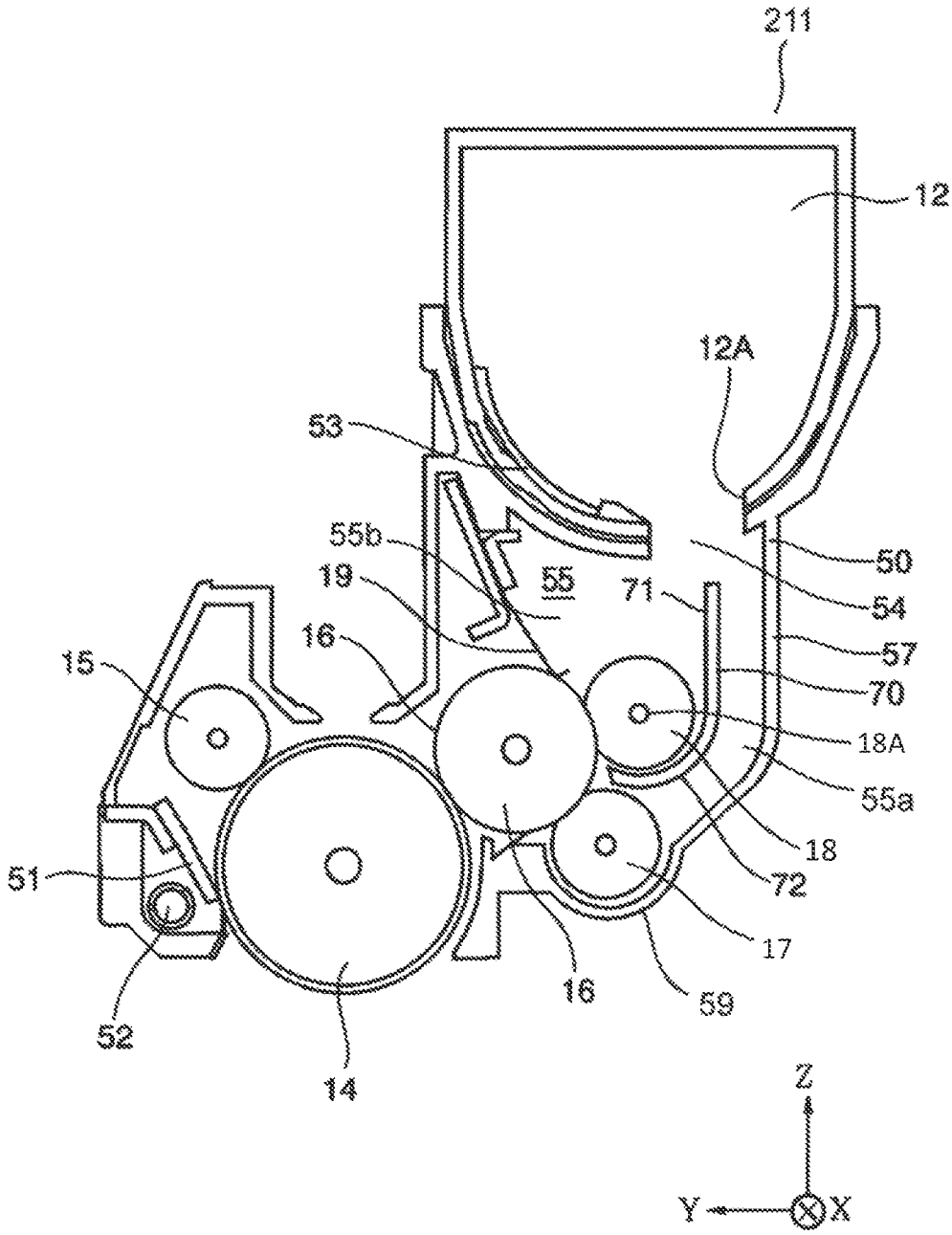
FIG. 12 is a sectional view of an image formation unit according to a second embodiment of the invention.

FIG. 12 is a sectional view of image formation unit 211 according to a second embodiment of the invention. In the second embodiment, configurations, the same as or corresponding to those in the first embodiment are denoted by the same reference numerals as the first embodiment and description thereof is omitted.

Image formation unit 211 of the second embodiment includes partition wall 70. Partition wall 70 is provided between first wall portion 57 and second supply roller 18 and partially extends along the outer circumference of second supply roller 18 on a side of second supply roller 18 that is the opposite side from development roller 16 across second supply roller 18. Partition wall 70 of the second embodiment is formed integrally with frame 50 of image formation unit 211, for example.

Specifically, partition wall 70 includes first wall portion 71 and second wall portion 72. First wall portion extends upwardly (toward toner cartridge 12) along the Z direction from a position that is the approximately same height as shaft 18A of second supply roller 18. Second wall portion 72 extends, along the outer circumference of second supply roller 18, downwardly from the position that is approximately the same height as shaft 18A of second supply roller 18. First wall portion 71 of partition wall 70 is provided approximately at the widthwise center of toner filler port 54 of frame 50 in the Y direction. Second wall portion 72 reaches a position between first supply roller 17 and second supply roller 18, for example.

Partition wall 70 divides toner that is moving downwardly in the Z direction from toner filler port 54 due to gravity, into an area 55*a* (first toner container room 55*a*) on a wall portion's (57) side of partition wall 70 (the right side of partition wall 70 in FIG. 12) and an area 55*b* (second toner container room 55*b*) on a second supply roller's (18) side (the left side of partition wall 70 in FIG. 12).

In the second embodiment, the outer diameter of photosensitive drum 14 is 30 [mm], the outer diameter of development roller 16 is 20 [mm], and the outer diameters of first and second supply rollers 17 and 18 are 13 [mm]. Amounts of pressing first supply roller 17 and second supply roller 18 into development roller 16 (that is, nip amounts between development roller 16 and first and second supply rollers 17 and 18) are 1 [mm]. The method of measurement of the nip amounts is the same as described above with reference to FIG. 3.

Circumferential velocities of supply rollers 17 and 18 are set less than that of development roller 16, as described in the first embodiment. Specific examples of the circumferential velocities and applied voltages of development roller 16 and supply rollers 17 and 18 are the same as those of the first embodiment. It is preferable that second wall portion 59 of frame 50 extends along the outer circumference of first supply roller 17, as described above in the first embodiment.

Flow of the toner in image formation unit 211 of the second embodiment will be described below.

Toner that is supplied from toner cartridge 12 through toner filler port 54 into toner container part 55 moves downward along the Z direction in toner container part 55. Then it is divided by partition wall 70 into the area 55*a* (first toner container room 55*a*) on a wall portion's (57) side of partition wall 70 (the right side of partition wall 70 in FIG. 12) and the area 55*b* (second toner container room 55*b*) on a second supply roller's (18) side (the left side of partition wall 70 in FIG. 12).

Note that first toner container room 55*a* is the area that is surrounded by, and defined by, the outer circumference of first supply roller 17, first wall portion 57 of frame 50, and partition wall 70. Second toner container room 55*b* is the area that is surrounded by, and defined by, the outer circumference of second supply roller 18, regulation blade 19, and partition wall 70.

In first toner container room 55*a*, toner that has reached the outer circumference of first supply roller 17 is conveyed by the rotation of first supply roller 17, reaches the contact (D, see FIG. 5) between first supply roller 17 and development roller 16, is triboelectrically charged by the friction between first supply roller 17 and development roller 16 and electrostatically attached to the surface of development roller 16, is conveyed by the rotation of development roller 16, and then reaches the contact (E, see FIG. 5) between development roller 16 and second supply roller 18.

A part of the toner that has reached the contact between development roller 16 and second supply roller 18 is attached to the surface of second supply roller 18. Most of that part is conveyed by the rotation of second supply roller 18 by being attached on the surface of second supply roller 18. The rest of the toner, which is not attached to second supply roller 18 and stays on development roller 16, is conveyed by development roller 16 and then passes through the contact (E and F, see FIG. 5) between development roller 16 and second supply roller 18.

On the other hand, in second toner container room 55*b*, toner that has reached the outer circumference of second supply roller 18 is attached to second supply roller 18 and thus is mixed with the toner that has been attached to, and conveyed by, first supply roller 17, development roller 16, and second supply roller 18 in that order. The toner is then conveyed by the second supply roller 18 to the exit area (H, see FIG. 5) of the contact between second supply roller 18 and development roller 16. The toner that has reached the exit area (H, see FIG. 5) of the contact between second supply roller 18 and development roller 16 is joined together with the toner that has been conveyed by development roller 16 and passed through the contact between development roller 16 and second supply roller 18. The joined toner is further triboelectrically charged by the friction between development roller 16 and second supply roller 18, thereby being electrostatically attached to development roller 16, conveyed by the rotation of development roller 16 to the contact (G, see FIG. 5) between regulation blade 19 and development roller 16.

The toner that has reached the contact between development roller 16 and regulation blade 19 is triboelectrically-charged by the friction between regulation blade 19 and development roller 16, while regulated by regulation blade 19 to be a toner layer of a uniform thickness, and is then conveyed by the rotation of development roller 16 to the contact area between development roller 16 and photosensitive drum 14. The toner that has reached the contact area between development roller 16 and photosensitive drum 14 is attached to an electrostatic latent image formed on photosensitive drum 14, thereby developing the electrostatic latent image with the toner.

As described above, the second embodiment has partition wall 70 in toner container part 55 configured to divide and distribute the toner that has been supplied from toner filler port 54 into the area 55*a* where first supply roller 17 is provided and the area 55*b* where second supply roller 18 is provided.

This configuration prompts supply of the toner to first supply roller 17 and second supply roller 18, even when the amount of the toner in toner container part 55 is still large.

Also, this configuration prevents short supply of the toner to second supply roller 18, which is provided above first supply roller 17, when the amount of the toner in toner container part 55 gets small. Specifically, with this configuration, even when the amount of the toner around first supply roller 17, which is provided under second supply roller, becomes small, there are still some toner around second supply roller 18 (in an area surrounded by second supply roller 18, partition wall 70, regulation blade 19), so as to supply an adequate amount of the toner to development roller 16.

As a result, the second embodiment can stabilize the image density to maintain the image quality.

Like the first embodiment, if the ratios of the circumferential velocities of supply rollers 17 and 18 to that of development roller 16 are set equal to or less than 1.0, attritions of supply rollers 17 and 18 are reduced so as to lengthen the life of image formation unit 11.

Note that image formation unit 211 of the second embodiment is not limited to the configuration shown in FIG. 12, however, it is preferable that toner container part 55 has partition wall 70 configured to divide and distribute the toner that has been supplied from toner cartridge 12 into toner container part 55 into the area (55*a*) where first supply roller 17 is provided and the area (55*b*) where second supply roller 18 is provided. Accordingly, for example, it is not required that partition wall 70 is formed integrally with frame 50, and thus partition wall 70 may be made from a metal plate and fixed to frame 50 with a screw(s) or the like. Also, the outer diameters of first and second supply rollers 17 and 18 may be different from each other.

Also, as described above in the first embodiment, in the case where conveyance plane CP is tilted with respect to the horizontal plane (see, FIG. 8), it is preferable or required that toner container part 55 is provided away from conveyance plane CP in the direction (the Z direction) orthogonal to conveyance plane CP, and it is preferable or required that partition wall 70 extends in the direction (the Z direction) orthogonal to conveyance plane CP and is positioned within toner filler port 54 in the direction (the Y direction) parallel to conveyance plane CP.

Further, the second embodiment may be combined with the first embodiment or the modifications of the first embodiment, arbitrarily. For example, partition wall 70 of the second embodiment may be added to image formation unit 11 shown in FIG. 2.

《3》 [Third Embodiment]

《3-1》 Configuration of the Third Embodiment

Figure 13:
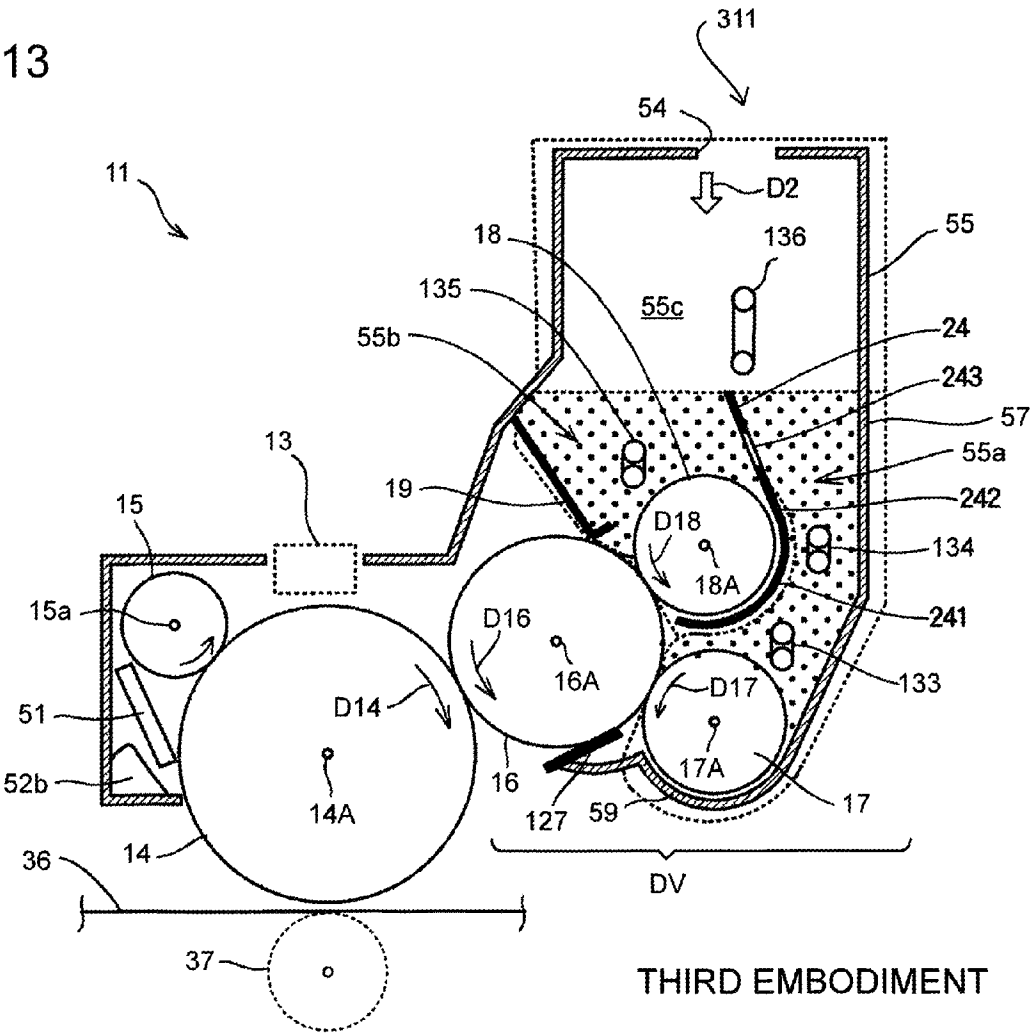
FIG. 13 is a vertical sectional view of a schematic configuration of an image formation unit according to a third embodiment.

FIG. 13 is a vertical sectional view schematically illustrating the configuration of image formation unit 311 according to the third embodiment. In the third embodiment, configurations, the same as or corresponding to those in the second embodiment are denoted by the same reference numerals as the third embodiment and description thereof will be omitted.

As shown in FIG. 13, partition wall 24 is provided in toner container part 55 of development unit DV in image formation unit 311 of the third embodiment. In toner container part 55, there are first toner container room 55*a* (a first developer container room) and second toner container room 55*b* (a second developer container room), which are separated by partition wall 24. Third toner container room 55*c* (a third developer container room) is provided above first toner container room 55*a* and second toner container room 55*b* in toner container part 55. Toner T that is supplied from the toner cartridge (not shown) enters into third toner container room 55*c* and then is supplied to first toner container room 55*a* and/or second toner container room 55*b*. An example of toner T is a developer comprising grounded particles (with an average particle diameter of 8 [μm]) formed by crushing a mix of a polyester resin, coloring agents, charge controlling agents, release agents, and external additive (hydrophobic silica).

The third embodiment further includes: agitation bar 133 and 134, serving as agitation members, provided in first toner container room 55*a*; agitation bar 135, serving as a agitation member, provided in second toner container room 55*b*; and agitation bar 136, serving as a agitation member, provided in third toner container room 55*c*. Second supply roller 18 is provided downstream from first supply roller 17 in the rotation direction of development roller 16 (in the direction of arrow D16). In the example shown in FIG. 13, second supply roller 18 is provided right above first supply roller 17. Note that the positional relationship between second supply roller 18 and first supply roller 17 is not limited to the example shown in FIG. 13.

Development roller 16 includes a metal shaft and an elastic member covering the outer circumference of the metal shaft, for example. In an example of development roller 16, the metal shaft has a diameter of 10 [mm] and the elastic member is semiconducting urethane rubber having a thickness of 3 [mm] and a rubber hardness of 70 degrees (ASKER Type C). The structure, material, and size of development roller 16 are not limited to this.

Each of first supply roller 17 and second supply roller 18 includes a metal shaft and a foam member coating an outer circumference of the metal shaft, for example. As an example of the supply rollers, the metal shaft has a diameter of 6 [mm] and the foam member is silicon foam having a thickness of 3.5 [mm] and a hardness of 50 degrees (ASKER Type F). In the third embodiment, the distance between shaft 17A of first supply roller 17 and shaft 16A of development roller 16 and the distance between shaft 18A of second supply roller 18 and shaft 16A of development roller 16 are 13.5 [mm]. A length of the contact between first supply roller 17 and development roller 16 in the circumferential directions is 1.0 [mm]. A length of the contact between second supply roller 18 and development roller 16 in the circumferential directions is 1.0 [mm]. The structures, materials, sizes, and positions of first and second supply rollers 17 and 18 are not limited to this. In the third embodiment, first supply roller 17 and second supply roller 18 have the same structure, material, and size as each other, however those may be different from each other.

Note that toner leak prevention film 127 is provided at toner container part 55 to prevent toner T from leaking from first toner container room 55*a*. An end of toner leak prevention film 127 is the outer wall of toner container part 55 of image formation unit 311 and the other end is in contact with the outer circumference of development roller 16. First supply roller 17 and second supply roller 18 that are configured to rotate in the directions of arrows D17 and D18, respectively, are in contact with development roller 16 configured to rotate in the direction of arrow D16.

Figure 14:
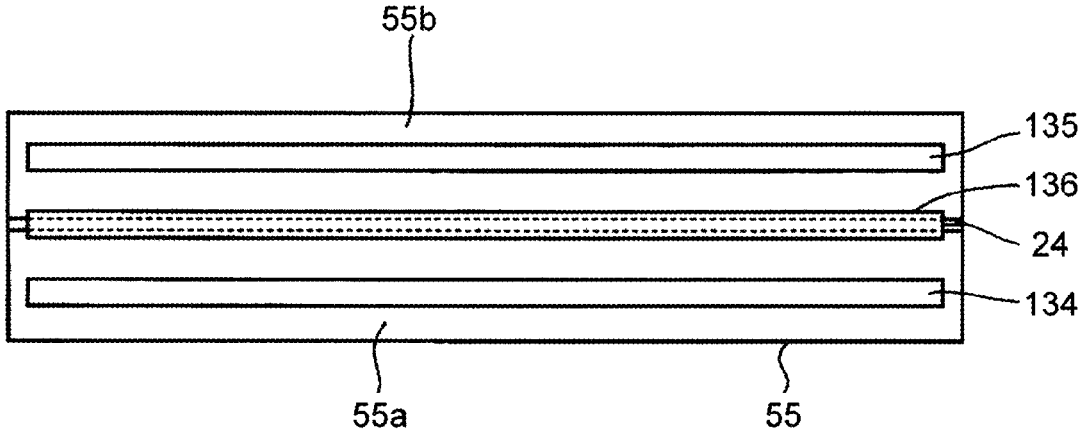
FIG. 14 is a plan view schematically illustrating the inside of a development unit (a development device) shown in FIG. 13, as seen from direction D2.

FIG. 14 is a plan view schematically illustrating the inside of toner container part 55 shown in FIG. 13, as seen from above (in the direction of arrow D2 in FIG. 13). As shown in FIG. 14, agitation bar 136 is provided in third toner container room 55*c* in toner container part 55. Agitation bar 136 is provided beneath toner filler port 54 of toner container part 55 and above partition wall 24. Agitation bar 136 has a structure (for example, a crank shaft structure) that causes toner T, that has been supplied from toner filler port 54, to move toward first toner container room 55*a* and second toner container room 55*b*. The shaft of agitation bar is provided rotatable with respect to toner container part 55 and is driven to rotate by means of a driving force from a driving mechanism or a driver (for example, a motor and a gear(s)).

As shown in FIG. 14, agitation bar 134 to agitate the toner in first toner container room 55*a*, and agitation bar 135 to agitate the toner in second toner container room 55*b*, are provided in toner container part 55. Although not being shown in FIG. 14, agitation bar 133 (see, FIG. 13) to agitate the toner is provided in first toner container room 55*a*. Agitation bars 133 and 134 have structures (for example, crank shaft structures) that agitate toner T in first toner container room 55*a* of toner container part 55. Agitation bars 133 and 134 are provided rotatable with respect to toner container part 55 and are driven to rotate by means of a drive source from a driving mechanism or a driver (for example, a motor and/or a gear(s)). Agitation bar 135 has a structure (for example, a crank shaft structure) that agitates toner T in second toner container room 55*b* in toner container part 55. Agitation bar 135 is provided rotatable with respect to toner container part 55 and is driven to rotate by means of a drive source from a driving mechanism or a driver (for example, a motor and/or a gear(s)).

Figure 15:
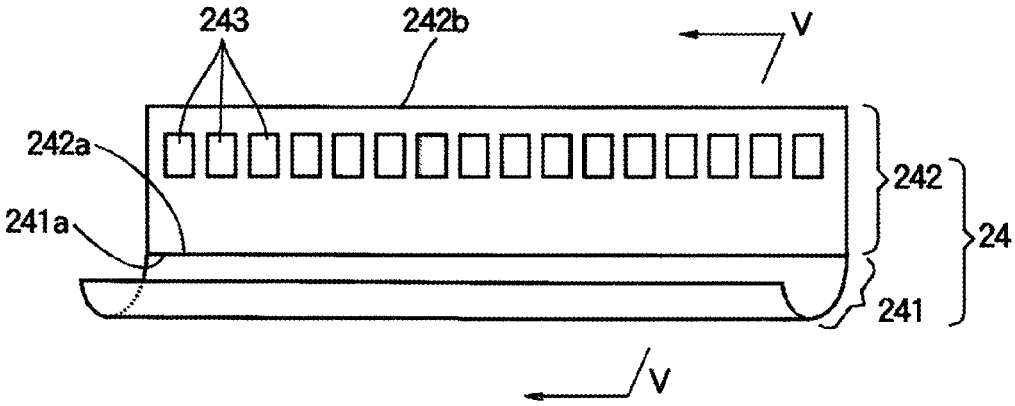
FIG. 15 is a perspective view schematically illustrating an example of a partition wall in a development unit shown in FIG. 13.
Figure 16:
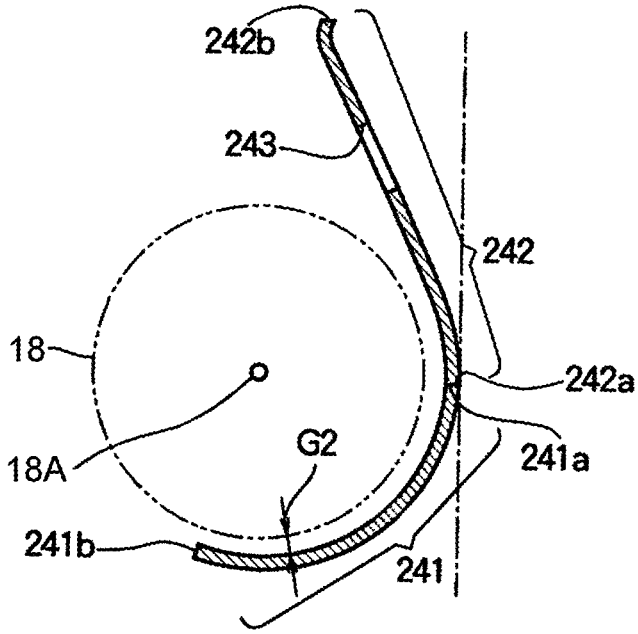
FIG. 16 is an enlarged, vertical sectional view schematically illustrating the example of the partition wall in the development unit shown in FIG. 13.

FIG. 15 is a perspective view schematically illustrating an example of partition wall 24 in development unit DV shown in FIG. 13. FIG. 16 is a vertical enlarged section view schematically illustrating an example of partition wall 24 of development unit DV shown in FIG. 13, which is taken along the V-V line in FIG. 15.

Partition wall 24 includes first wall portion 241 and second wall portion 242. First wall portion 241 extends along and covers a lower side of the outer circumference of second supply roller 18 with a small gap between first wall portion 241 and second supply roller 18. Second wall portion 242 extends upwardly, from an end 241*a*(side 241*a*) of first wall portion 241 that is not the other end 241*b* close to development roller 16, to an upper side of second supply roller 18 (in the upper left direction in FIG. 16). First wall portion 241 is fixed to toner container part 55 of image formation unit 311. Second wall portion 242 has end 242*a*(side 242*a*) which is fixed to end 241*a*(side 241*a*) of first wall portion 241 and end 242*b*(side 242*b*) that is the opposite side of end 242*a*. Note that second wall portion 242 of partition wall 24 may be configured such that end 242 b of second wall portion 242 can move toward a side of first toner container room 55*a* and a side of second toner container room 55*b*, alternatively.

Partition wall 24, which separates first toner container room 55*a* from second toner container room 55*b*, in toner container part 55, has its longitudinal direction along the direction of the axis of second supply roller 18 (that is, the direction orthogonal to the plane of the paper in FIG. 16. Second wall portion 242 of partition wall 24 is formed with plural holes 243 through which toner T can pass between first toner container room 55*a* and second toner container room 55*b*. Note that, if holes 243 are provided at first wall portion 241 which faces the outer circumference of second supply roller 18, a force that pushes toner T to second supply roller 18 by means of partition wall 24 may be decreased and thus an amount of toner T that is attached to second supply roller 18 may be decreased. This is why it is preferable that holes 243 are provided at second wall portion 242 of partition wall 24. In the embodiment, each hole 243 is a 5 mm×5 mm square, and holes 243 are lined in the longitudinal direction. For example, holes 243 are lined in a row in second wall portion 242. Note that a number, shape, size, position and alignment of holes 243 may be determined based on properties of toner T and the components of development unit DV, or the like.

In the third embodiment shown in FIGS. 15 and 16, first wall portion 241 has a curved shape extending along the lower side of the outer circumference of second supply roller 18. Note that the shape of first wall portion 241 is not limited to the example shown in the Figures and may have another shape. A distance (distance G2 in FIG. 16) between second supply roller 18 and first wall portion 241 of partition wall 24 is preferably set in a range where a function of supplying toner T to second supply roller 18 is not too impaired. For example, distance G2 is preferably in a range of not less than 0.5 [mm] and not greater than 2.0 [mm], and is more preferably 1.5 [mm]. Likewise, the relationship between first supply roller 17 and second wall portion 59 of toner container part 55 is preferably the same as the described relationship between second supply roller 18 and first wall portion 241.

That is, a distance (distance G1 in FIG. 17) between first supply roller 17 and wall portion 59 of toner container part 55 is preferably in a range where a function of supplying toner T to first supply roller 17 is not too impaired. For example, distance G1 is preferably in a range of not less than 0.5 [mm] and not greater than 2.0 [mm], and is more preferably 1.5 [mm]. If distances G1 and G2 are less than 0.5 [mm], first and second supply rollers 17 and 18 may undesirably come in contact with the wall portions and thus become scratched, which is undesirable. On the other hand, when distances G1 and G2 are greater than 2.0 [mm], the pressure that pushes toner T toward first and second supply rollers 17 and 18 by means of the wall portions may be too weak, and thus toner T may not be attached to the surfaces of first and second supply rollers 17 and 18.

Figure 17:
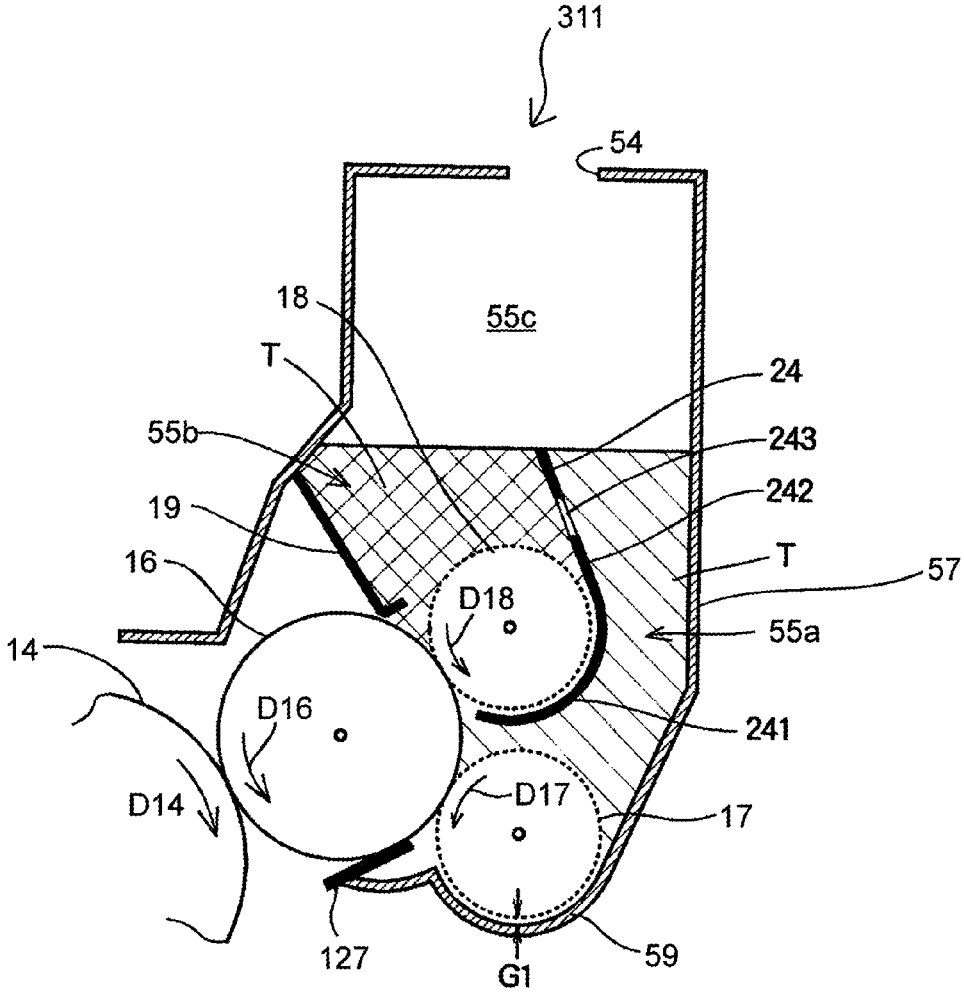
FIG. 17 is a view illustrating volumetric capacities of first and second toner container rooms shown in FIG. 13.

FIG. 17 is a view illustrating volumetric capacities of first and second toner container rooms 55*a* and 55*b*. It is preferable that the volumetric capacity (indicated by hatching in FIG. 17) of first toner container room 55*a*, which is the maximum amount of toner T that first toner container room 55*a* can contain therein, is the same as the volumetric capacity (indicated by cross-hatching in FIG. 17) of second toner container room 55*b*, which is the maximum amount of toner T that second toner container room 55*b* can contain therein. The reason is to prevent one of first and second toner container rooms 55*a* and 55*b* from running out of toner T excessively too faster than the other, since first supply roller 17 and second supply roller 18 are generally operated in the same condition and consume approximately the same amount of toner T. Note that the volumetric capacities of first and second toner container room 55*a* and 55*b* are not necessarily the same, and the volumetric capacities of first and second toner container room 55*a* and 55*b* may be set different from each other in consideration of a difference in toner consumption rates between first supply roller 17 and second supply roller 18, or another factor. For example, in the case where the toner consumption rate of first supply roller 17 is less than that of second supply roller 18, the capacity of second toner container room 55*b* may be set greater than that of first toner container room 55*a*. As an example, a proportion of the capacity of first toner container room 55*a* to that of second toner container room 55*b* may be set the same as a proportion of the toner consumption rate of first supply roller 17 to that of second supply roller 18.

《3-2》 Operation of the Third Embodiment

In image formation unit 311 of image formation apparatus 10 according to the third embodiment, toner T from the toner cartridge through toner filler port 54 passes through third toner container room 55*c*, and is distributed to both of first toner container room 55*a* and second toner container room 55*b*.

When image formation apparatus 10 becomes in a toner supply mode, an unillustrated drive mechanism, such as a motor and a gear(s), is activated to rotate agitation bars 136, 135, and 133 and transport agitation bar 134. Toner T that has been supplied from the toner cartridge through toner filler port 54 into third toner container room 55*c* is distributed to both of second toner container room 55*b* and first toner container room 55*a*, by means of gravity and the rotation of agitation bar 136 in third toner container room 55*c*. Toner T in second toner container room 55*b* is agitated by agitation bar 135 and is thus prevented from being flocculated. After being agitated by agitation bar 135, toner T is attached to the surface of second supply roller 18. On the other hand, toner T in first toner container room 55*a* moves downward by gravity, as being agitated by the rotation of transport agitation bar 134, and is agitated again by agitation bar 133 in the vicinity of first supply roller 17 and then is attached to the surface of first supply roller 17.

When image formation apparatus 10 receives an print instruction, an unillustrated drive mechanism, such as a motor and a gear(s), is activated to rotate photosensitive drum 14 in the direction of arrow D14, rotate development roller 16 in the direction of arrow D16, rotate second supply roller 18 in the direction of arrow D18, and rotate first supply roller 17 in the direction of arrow D17, as shown in FIG. 13. For example, in the case where photosensitive drum 14 is driven to rotate at a linear velocity (circumferential velocity) of 130 [mm/s], development roller 16 rotates at a linear velocity of 156 [mm/s], second supply roller 18 rotates at a linear velocity of 109 [mm/s], and first supply roller 17 rotates at a linear velocity of 109 [mm/s]. When photosensitive drum 14 rotates, charge roller 15 is driven by the rotation of photosensitive drum 14 to rotate and, thereby, uniformly charges the surface of photosensitive drum 14. After that, LED head 13 emits light in accordance with print image data onto the charged surface of photosensitive drum 14 to form an electrostatic latent image on the charged surface of photosensitive drum 14.

Meanwhile, toner T that is attached to the surface of first supply roller 17 is supplied to the surface of development roller 16, while toner T that is attached to the surface of second supply roller 18 is also supplied to the surface of development roller 16. Toner T that is attached to the surface of development roller 16 is regulated or metered by regulation blade 19 to be a toner layer of a constant thickness. The layer of toner T on the surface of development roller 16 comes in contact with the surface of photosensitive drum 14 and is attached to the electrostatic latent image on photosensitive drum 14, thereby a toner image (a developer image) is formed on the surface of photosensitive drum 14.

Figure 18A:
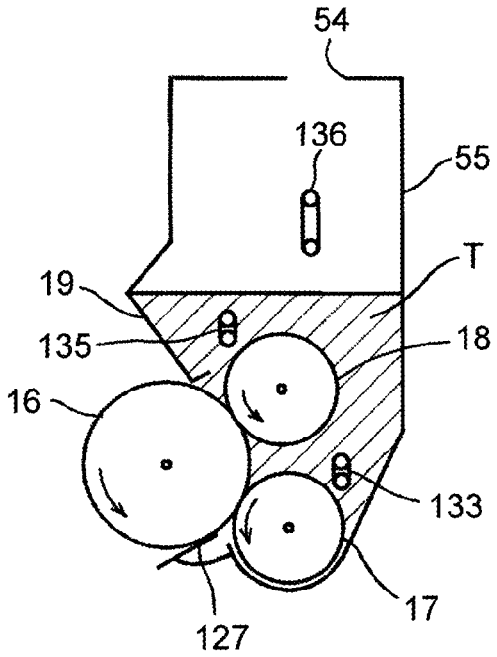
FIGS. 18A and 18B are views for explaining a problem in a comparison example that does not have the partition wall.
Figure 18B:
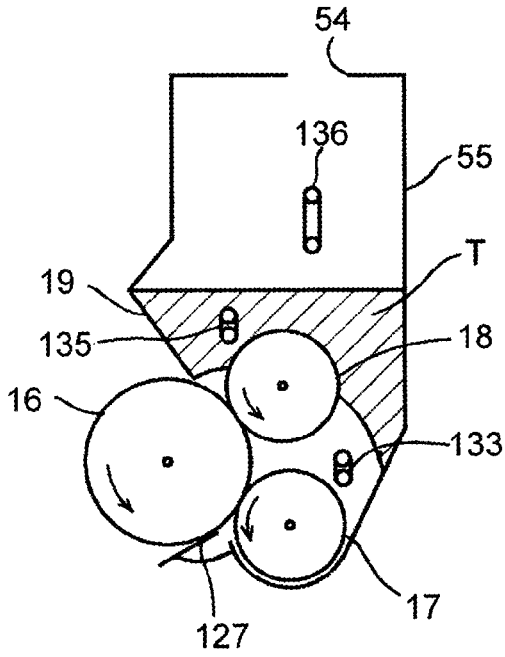

FIGS. 18A and 18B are explanatory views, for explaining problems in a comparison example of a development unit that does not have the partition wall. In FIGS. 18A and 18B, configurations, the same as or corresponding to those in the fourth embodiment (FIG. 13), are denoted by the same reference numerals as in the fourth embodiment. The development unit according to the comparison example is different from the fourth embodiment shown in FIG. 13 in that the comparison example does not have partition wall 24 and agitation bar 134. In an image formation apparatus according to the comparison example shown in FIGS. 18A and 18B having only one toner container room in toner container part 55, toner container part 55 is necessarily filled with toner T as indicated by the hatching in FIG. 18A. However, in the case where the external additives are detached from the toner body due to a long-term usage and thus toner clumps are generated, as indicated by the hatching in FIG. 18B, there is the possibility that toner T is not supplied to a periphery of first supply roller 17 at a lower portion of toner container room 55. In that case, only second supply roller 18 provided at an upper portion of toner container room 55 supplies toner T to development roller 16. This decreases the amount of toner T that is supplied to development roller 16, thereby increasing the possibility that a fade occurs in a printed image.

After a solid black pattern (a print target density of 100%) is printed on the entire surface of a paper sheet of A4 size by using the image formation apparatus having development unit DV shown in FIG. 13 according to the third embodiment and an image formation apparatus having development unit DV shown in FIGS. 18A and 18B according to the comparison example, occurrence of fading is evaluated. Specifically, the occurrence of, and the degree of, "fading" is evaluated by visibly checking the printed paper sheet, after a solid black pattern (a print density of 100%) with 100% coverage and an optical density of 1.5 is printed on the entire surface of a paper sheet of A4 size. The evaluation is executed by comparing a top section of the printed sheet, which is a section of 0 cm to 5 cm from the top of the printed sheet (the leading end of the sheet in the conveyance direction), with a bottom section of the printed sheet, which is a section of 0 to 5 cm from the bottom of the printed sheet (the tail end of the sheet in the conveyance direction), and next visibly checking for an area that is not more than an optical density of 1.2 in the bottom area of the printed sheet. Specifically, in the case where the top area of the printed sheet is outputted at an optical density of 1.5, the bottom area of the printed sheet is visibly checked to determine an area that has optical density of not more than 1.2 in the bottom section of the printed sheet. If the area that has an optical density of not more than 1.2 covers not less than 30% in the bottom section, it is determined to be "entire fading". If the area that has optical density of not more than 1.2 covers less than 30% in the bottom section, it is determined to be "partial fading". If the area that has an optical density of not more than 1.2 covers 0% in the bottom section, it is determined to be "no fading". A result shown in Table 1 is obtained. In Table 1, "o" indicates that "no fading" exists, "Δ" indicates that "partial fading" exists, and "x" indicates that the "entire fading" exists.

TABLE 1

COMPARISON BETWEEN THIRD EMBODIMENT WITH PARTATION WALL 24 AND COMPARISON EXAMPLE THAT DOES NOT HAVE PARTATION WALL

"○" indicates that "no fading" exists
"Δ" indicates that "partial fading" exists
"x" indicates that "entire fading" exists

| | THE NUMBER OF PRINTED SHEETS [SHEETS] | | | |
|---|---|---|---|---|
| | SEVERAL | 10000 | 20000 | 30000 |
| COMPARISON EXAMPLE (FIGS. 18A AND 18B) | ○ | Δ | x | x |
| THIRD EMBODIMENT (FIG. 13) | ○ | ○ | ○ | Δ |

In the image formation apparatus according to the comparison example which does not have the partition wall, "partial fading" occurs after 10000-sheet printing and "entire fading" occurs after 20000-sheet printing. This is because, in the image formation apparatus of the comparison example, after the long-term usage, the external additives are detached from the toner body and thus toner clumps are generated, thereby toner T is hardly supplied to first supply roller 17, as shown in FIG. 18B. In this case, only second supply roller 18 can supply development roller 16, which decreases the amount of toner T that is supplied to development roller 16 and causes fading.

According to the third embodiment, toner T in toner container part 55 can intercommunicate between first toner container room 55*a* and second toner container room 55*b* through holes 243 of partition wall 24. This prevents one of first and second toner container rooms 55*a* and 55*b* from accommodating excessively more amount of toner T than the other of rooms 55*a* and 55*b*. According to the third embodiment, transport agitation bar 134 in first toner container room 55*a* prevents toner T from being clumped, so as to prompt the transportation of toner T to first supply roller 17. Accordingly, toner T is attached both of the second supply roller 18 and first supply roller. Therefore, the third embodiment can stably supply toner T to development roller 16 with the two supply rollers 17 and 18.

Figure 19A:
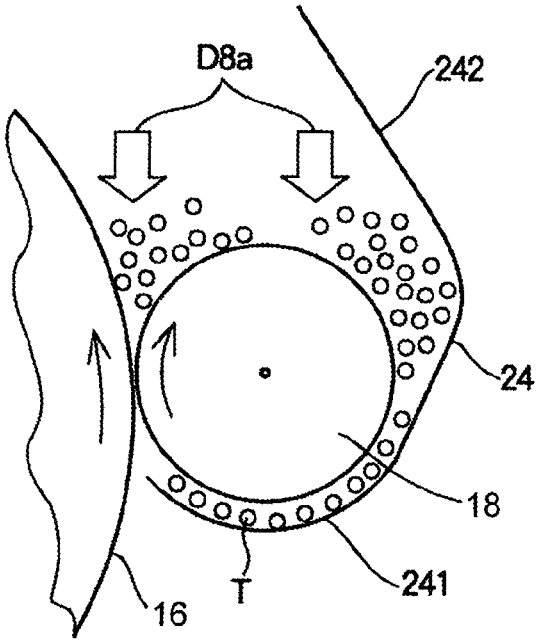
FIG. 19A is a view of the third embodiment, illustrating a flow of toner to be supplied to a second supply roller in the development unit of the third embodiment.
Figure 19B:
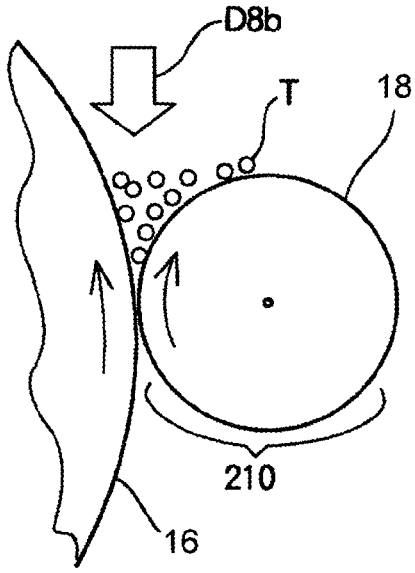
FIG. 19B is a view of a comparison example with respect to the third embodiment, illustrating a flow of toner to be a second supply roller in a development unit that does not have the partition wall.

FIG. 19A is a view of the third embodiment, illustrating a flow of toner T to be supplied to second supply roller 18 in development unit DV of the third embodiment, and FIG. 19B is a view of a comparison example with respect to the third embodiment, illustrating a flow of toner T to second supply roller 18 in development unit DV that does not have the partition wall.

As shown in FIG. 19B, in the comparison example which has only one toner container room in the development unit, second supply roller 18 is disposed close to development roller 16, and there is no wall (corresponding to partition wall 24 in FIG. 19A) in the vicinity of the outer circumference of second supply roller 18. Therefore, in the comparison example shown in FIG. 19B, when the amount of toner T in the toner container room gets small, toner T is supplied from above second supply roller 18 in the direction of arrow D8*b* to an area around the contact between development roller 16 and second supply roller 18 and thus toner T is rarely supplied to second supply roller 18 from a lower side 210 of second supply roller 18 (from an upstream side 210 of second supply roller 18 in the rotational direction). Thus, in the comparison example shown in FIG. 19B, the amount of toner T that is supplied from second supply roller 18 to development roller 16 is very small.

In contrast, in the third embodiment shown in FIG. 19A, first wall portion 241 of partition wall 24 is provided with a small gap (G2 in FIG. 16) between first wall portion 241 and the outer circumference of second supply roller 18, and second wall portion 242 of partition wall 24 is provided above first wall portion 241 of partition wall 24 to guide toner T toward second supply roller 18. Accordingly, if the amount of toner T in the toner container room gets small, toner T is supplied from above second supply roller 18 to an area above the contact between development roller 16 and second supply roller 18 in the direction of arrow D8*a* and is also supplied to a lower side (210) of second supply roller 18 (an upstream side of second supply roller 18 in the rotational direction (210)). Therefore, in the third embodiment shown in FIG. 19A, the amount of toner T that is supplied from second supply roller 18 to development roller 16 becomes very large. On the other hand, in the comparison example shown in FIG. 19A, when toner T in the toner container room gets small, the contact area between toner T and second supply roller 18 gets decreased and a pressure between toner T and second supply roller 18 gets decreased, and thus the amount of toner T that is attached to second supply roller 18 decreases. In the third embodiment shown in FIG. 19A, the wall member (first wall portion 241 of partition wall 24) in the vicinity of the outer circumference of second supply roller 18 keeps the pressure between toner T and second supply roller 18 high to attach toner T to second supply roller 18, even if toner T is deteriorated. Consequently, the third embodiment can stably attach toner T to two supply rollers (first supply roller 17 and second supply roller 18), and thus can stably supply toner T to development roller 16 from two supply rollers 17 and 18.

《3-3》 [Effects of the Third Embodiment]

As described above, the third embodiment can continuously supply a stable amount of toner to development roller 16 through first and second supply rollers 17 and 18.

Image formation unit 311 and image formation apparatus 10 according to the third embodiment can form a high quality image on recording medium 20.

《4》 [Fourth Embodiment]

《4-1》 Configuration of the Fourth Embodiment

Figure 20:
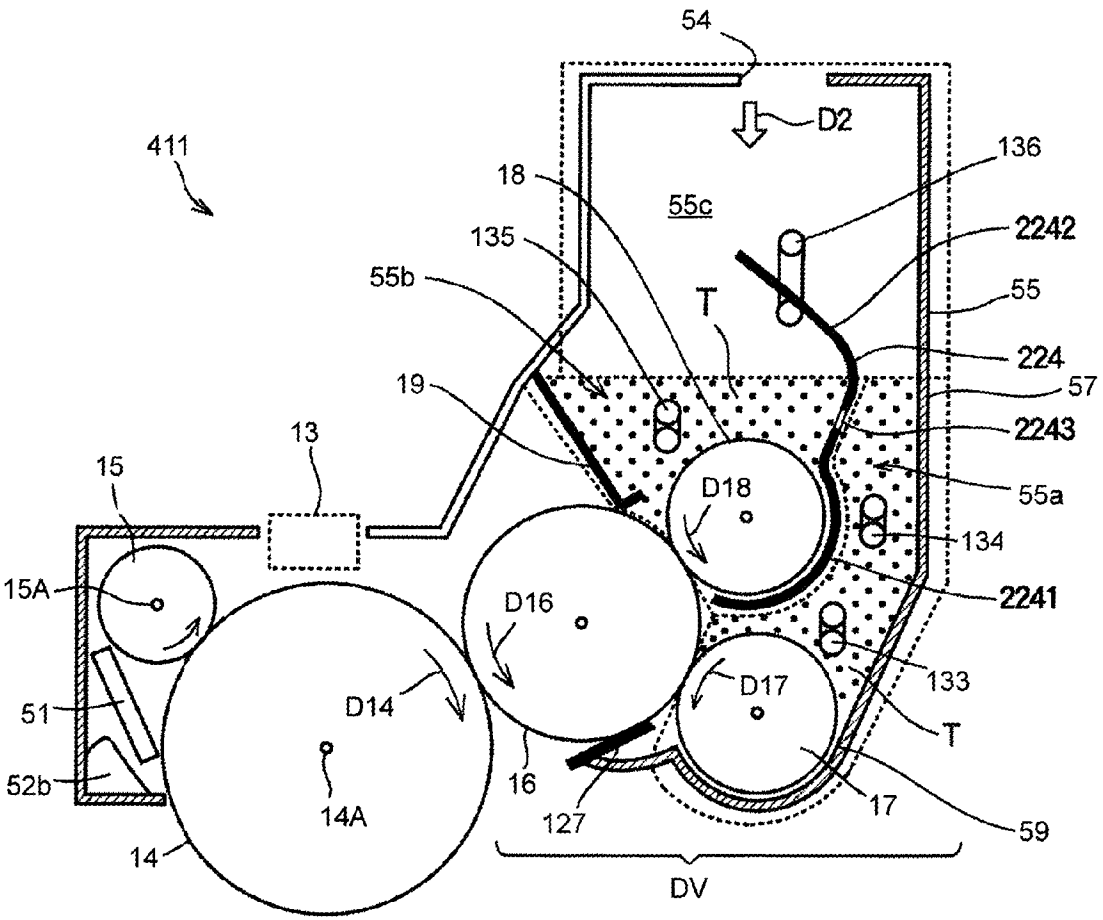
FIG. 20 is a vertical sectional view schematically illustrating the configuration of an image formation unit according to a fourth embodiment.

FIG. 20 is a vertical sectional view schematically illustrating the configuration of image formation unit 411 according to a fourth embodiment. In the fourth embodiment, configurations, the same as or corresponding to those in the third embodiment are denoted by the same reference numerals as in the third embodiment and description thereof is omitted. Image formation unit 411 according to the fourth embodiment is different from image formation unit 311 according to the third embodiment in that partition wall 224 of the fourth embodiment vibrates. In image formation unit 411 according to the fourth embodiment, toner container part 55 of development unit DV (development device) includes partition wall 224 which divided the inside of toner container part 55 to form first toner container room 55*a* and second toner container room 55*b*. A part (second wall portion) of partition wall 224 is formed of film 2242, serving as a flexible member or an elastic member. Film 2242 is configured to vibrate (reciprocate, swing, sway, or the like) by being in contact with agitation bar 136 rotating in third toner container room 55*c*. Like first wall portion 241 of the third embodiment, first wall portion 2241 of partition wall 224, which faces the outer circumference of second supply roller 18, is curved along the outer circumference of second supply roller 18 with a small gap between first wall portion 2241 of partition wall 224 and the outer circumference of second supply roller 18.

Figure 21:
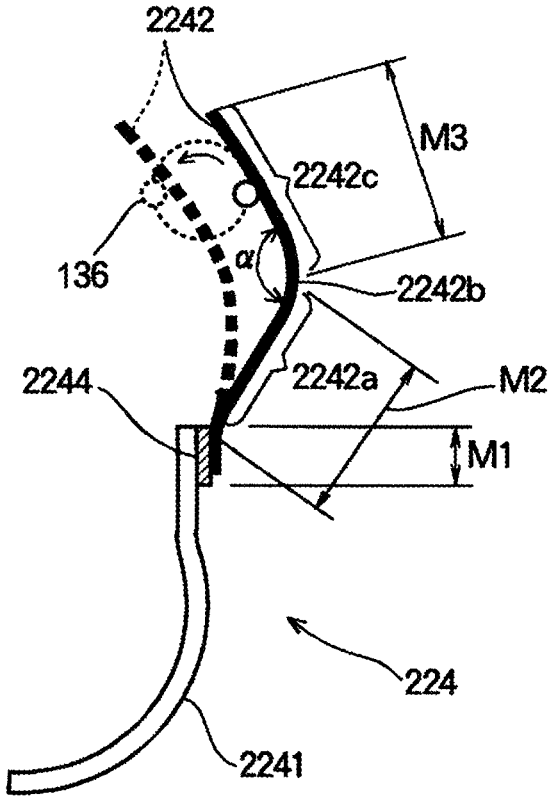
FIG. 21 is a side view schematically illustrating an operation of a partition wall in a development unit (a development device) shown in FIG. 20.
Figure 22:
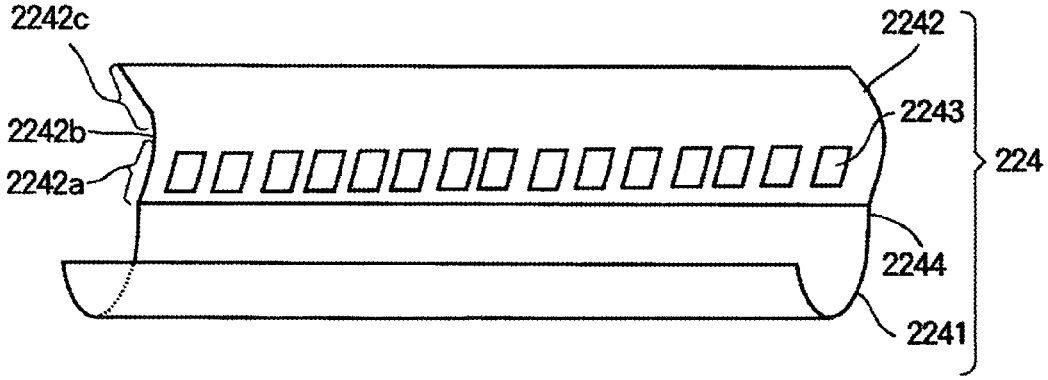
FIG. 22 is a perspective view schematically illustrating an example of the partition wall in the development unit shown in FIG. 20.

FIG. 21 is a side view schematically illustrating an operation of partition wall 224 in development unit DV shown in FIG. 20. FIG. 22 is a perspective view schematically illustrating an example of partition wall 224 in development unit DV shown in FIG. 20.

As shown in FIG. 21, film 2242 (movable member), which is the second wall portion of partition wall 224 is connected to an end of wall member, which is the first wall portion 2241, by means of connecting member 2244. Connecting member 2244 may be an adhesive double coated tape or the like, for example. Note that connecting member 2244 is not limited to an adhesive double coated tape, but may be any material or structure that can firmly connect wail member 2241 and film 2242, such as a bond or etc. Film 2242 is disposed in contact with agitation bar 136 in third toner container room 55*c* such that film 2242 has bend portion 2242*b* at angle $\alpha$, as shown in FIG. 21. In the fourth embodiment, a circumferential length of the revolution of agitation bar 136 is 4 [mm], the bent angle a of bent portion 2242*b* of film 2242 is 120 degree, free length M2 of first flat portion 2242*a*, which is a portion from the base end of film 2242 to bent portion 2242*b*, is 20 [mm], free length M3 of second flat portion 2242*c*, which is a portion from bent portion 2242*b* to the free end of film 2242 , is 20 [mm], and a length M1 of connecting member 2244 is 5 [mm]. An example of film 2242 as an elastic member is polyester film (mylar film) with a thickness of 0.2 [mm].

As shown in FIG. 22, first flat portion 2242*a* of film 2242 of partition wall 224 between second toner container room 55*b* and first toner container room 55*a* is formed with holes 2243, through which toner T can pass. Holes 2243 have a size of 5×5 [mm] and are aligned in the longitudinal direction of partition wall 224. Note that the structure of partition wall 224 is not limited to that shown in FIGS. 21 and 22.

《4-2》 Operation of the Fourth Embodiment

Figure 23A:
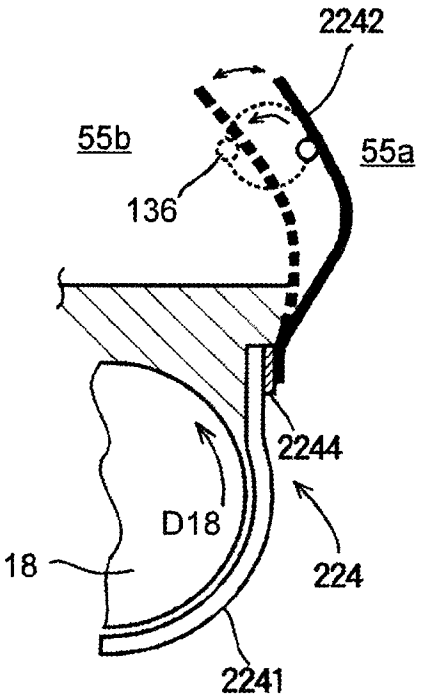
FIGS. 23A, 23B, and 23C are side views schematically illustrating operations of the partition wall shown in FIG. 20.
Figure 23B:
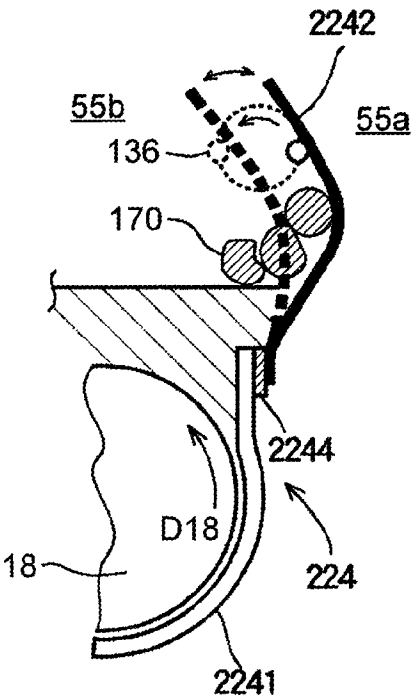
Figure 23C:
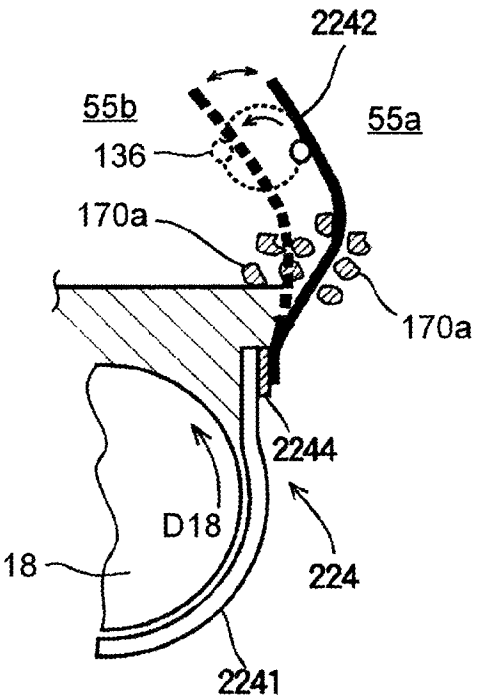

FIGS. 23A, 23B, and 23C are side views schematically illustrating operations of partition wall 224 in development unit DV shown in FIG. 20. As shown in FIG. 23A, upon the revolution of agitation bar 136, agitation bar 136 comes in contact with film 2242, which first causes film 2242 to move from a first position indicated by a dotted line to a second position indicated by a solid line. After that, due to the elastic resilience of film 2242, film 2242 moves back from the second position (solid line) to the first position (dotted line). That is to say, film 2242 vibrates (swings, sways, or etc.) with the revolution of agitation bar 136.

Film 2242 vibrates with the revolution of agitation bar 136 (as shown in FIG. 23A) and thus vibrates toner clump 170 and breaks toner clump 170 into small toner clumps 170*a*, as shown in FIG. 23C. With this, small toner clumps 170*a* possibly pass through holes 2243 formed at film 2242. That is, small toner clumps 170*a* can move from second toner container room 55*b* to first toner container room 55*a* or move from first toner container room 55*a* to second toner container room 55*b*.

After a solid black pattern (a print target density of 100%) is printed on the entire surface of a paper sheet of A4 size by using the image formation apparatus having development unit DV shown in FIG. 13 according to the third embodiment and an image formation apparatus having development unit DV shown in FIG. 20 according to the fourth embodiment, occurrence of fading is evaluated. This evaluation is executed under a high pressure and high humidity environment (temperature: 27 to 28 degree C., humidity: 70 to 80%). Specifically, occurrence of and degree of "fading" is evaluated by visibly checking the printed paper sheet, after a solid black pattern (a print density of 100%) with 100% coverage and an optical density of 1.5 is printed on the entire surface of a paper sheet of A4 size. The evaluation is executed by comparing a top section of the printed sheet, which is a section of 0 cm to 5 cm from the top of the printed sheet (the leading end of the sheet in the conveyance direction), with a bottom section of the printed sheet, which is a section of 0 to 5 cm from the bottom of the printed sheet (the tail end of the sheet in the conveyance direction), and next visibly checking an area that is not more than an optical density of 1.2 in the bottom area of the printed sheet. Specifically, since the top area of the printed sheet is outputted at an optical density of 1.5, the bottom area of the printed sheet is visibly checked to determine an area that has optical density of not more than 1.2 in the bottom section of the printed sheet. If the area that has an optical density of not more than 1.2 covers not less than 30% in the bottom section, it is determined to be "entire fading". If the area that has an optical density of not more than 1.2 covers less than 30% in the bottom section, it is determined to be "partial fading". If the area that has an optical density of not more than 1.2 covers 0% in the bottom section, it is determined to be "no fading". A result shown in Table 2 is obtained. In Table 2, "○" indicates that "no fading" exists, "Δ" indicates that "partial fading" exists, "x" indicates that the "entire fading" exists.

TABLE 2

COMPARISON BETWEEN THIRD EMBODIMENT WITH PARTATION WALL 24 AND FOURTH EMBODIMENT WITH PARTATION WALL 224

"○" indicates that "no fading" exists
"Δ" indicates that "partial fading" exists
"x" indicates that "entire fading" exists

| | THE NUMBER OF PRINTED SHEETS [SHEETS] | | | |
|---|---|---|---|---|
| | SEVERAL | 10000 | 20000 | 30000 |
| THIRD EMBODIMENT (FIG. 13) | ○ | ○ | Δ | Δ |
| FOURTH EMBODIMENT (FIG. 20) | ○ | ○ | ○ | ○ |

In the image formation apparatus of the third embodiment, "partial fading" occurs after 20000-sheet printing. This is because a high temperature and high humidity environment decreases the flow property of toner T and causes toner T to be clumped to make toner clump (s) 170, and this hinders movement of toner T in first toner container room 55*a*. In this case, since only second supply roller 18 can supply development roller 16, fading occurs. In contrast, in the image formation apparatus of the fourth embodiment, even if toner clump 170 occurs, film 2242 that vibrates breaks toner clump 170, which prompts movements of toner T in both of first toner container room 55*a* and second toner container room 55*b*. This stabilizes the toner supply to development roller 16 by using both of first supply roller 17 and second supply roller 18, and prevents fading.

《4-3》 Effects of the Fourth Embodiment

As described above, the fourth embodiment can continuously supply a stable amount of toner T to development roller 16 with first and second supply rollers 17 and 18, even under an environment that is highly likely to cause toner clumps, such as a high temperature and high humidity environment.

Further, image formation unit 411 and the image formation apparatus according to the fourth embodiment can form a high quality image on a recording medium.

《5》 [Modifications of the Third and Fourth Embodiment]

Although image formation units 311 and 411 of the third and fourth embodiments provide first and second toner container rooms 21 and 22 and 221 and 222 having first and second supply rollers 17 and 18 therein, respectively, an image formation unit may have three or more toner container rooms each of which has a supply roller. In that case, an amount of toner T supplied to development roller 16 may increase more, so as to reduce an occurrence of fading. Note that the number of the toner container rooms and the number of the supply rollers can be determined, depending on requirements for the image formation apparatus (such as, a required image quality, a required overall size, a manufacture cost, a price of manufactured product, or the like).

In the third and fourth embodiments, second wall portion (upper portion) 241 (2241) of partition wall 24 (224) extends obliquely upward as being inclined toward development roller 16. Second wall portion (upper portion) 241 (2241) of partition wall 24 (224) may extend upward in the vertical direction. In such a case where second wall portion 241 (2241) of partition wall 24 (224) extends upward in the vertical direction (the direction of gravitational force) or in an approximately vertical direction, toner T is easily supplied to an upstream portion of second supply roller 18 in the rotational direction of second supply roller 18, and thus the amount of toner T that is supplied from second supply roller 18 to development roller 16 is increased. Adversely, to decrease the amount of toner T that is supplied from second supply roller 18 to development roller 16, second wall portion 241 (2241) of partition wall 24 (224) may be necessarily bent and extended toward an upper side of second supply roller 18 (for example, bent angle $\alpha$ in FIG. 21 may be necessarily decreased).

Although the image formation apparatus is the electrophotographic color printer in the above embodiments, the invention can be applied, for example, to other type printers such as a monochrome printer or a four-cycle type color printer that has one image carrier to form four color images in four cycles. Also, the invention can be applied to other apparatus such as a copy machine, a facsimile machine, and a MFP (Multifunctional Peripheral). The number of the image formation unit is not limited to four and may be less than four or more than four in the invention. The light source of the exposure device is not limited to LED and may be another light source such as a laser light source. The structures of conveyance belt 36 and drive rollers 36*a* and 36*b* are not limited to the structures that are illustrated in the Figures.

Although the above embodiments employ a direct transfer type where transfer belt unit 35 conveys recording medium 20 and a toner image (developer image) is transferred to recording medium 20, the invention is not limited to the direct transfer type. That is, the invention can be applied to an intermediate transfer type where a toner image is firstly transferred from photosensitive drum 14 to transfer belt 36 of transfer belt unit 35 and then the toner image is secondary transferred from transfer belt 36 to recording medium 20. In this case, a conveyance plane of transfer belt 36 that moves in contact with photosensitive drum 14 in the intermediate transfer type corresponds to conveyance plane CP for recording medium 20 in the direct transfer type.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation unit comprising:

an image carrier on which a latent image can be formed;

a developer carrier configured to retain a developer thereon and to supply the developer to the image carrier to form a developer image on the image carrier;

a first developer supply member configured to retain the developer thereon and to supply the developer to the developer carrier;

a second developer supply member provided above the first developer supply member and configured to retain the developer thereon and to supply the developer to the developer carrier;

a developer container part configured to contain therein the developer and accommodating therein the first and second developer supply members; and a developer supply prompt structure configured to prompt a supply of the developer to the first developer supply member in the developer container part, wherein the developer supply prompt structure comprises a first developer container room and a second developer container room in the developer container part.

2. The image formation unit according to claim 1, wherein the developer supply prompt structure comprises a structure wherein the first developer supply member protrudes out further than the second developer supply member toward an opposite side of the developer carrier.

3. The image formation unit according to claim 2, further comprising an image transfer unit with a conveyance plane configured to transfer the developer image onto the conveyance plane or a recording medium on the conveyance plane, and to convey the developer image in the conveyance plane, wherein the developer supply prompt structure comprises a structure wherein the first developer supply member protrudes out further than the second developer supply member toward an opposite side of the developer carrier in the conveyance plane.

4. An image formation unit comprising:

an image carrier on which a latent image can be formed;

a developer carrier configured to retain a developer thereon and to supply the developer to the image carrier to form a developer image on the image carrier;

a first developer supply member configured to retain the developer thereon and to supply the developer to the developer carrier;

a second developer supply member provided above the first developer supply member, configured to retain the developer thereon and to supply the developer to the developer carrier; and a developer container part configured to contain therein the developer and accommodating therein the first and second developer supply members, wherein the first developer supply member protrudes out further than the second developer supply member toward an opposite side of the developer carrier, wherein a distance between a first tangent line and a second tangent line is greater than a distance between the first tangent line and a third tangent line, where the first tangent line is a vertical tangent line to the developer carrier; the second tangent line is one of vertical tangent, lines to the first developer supply member that is away from the developer carrier; and the third tangent line is one of vertical tangent lines to the second developer supply member that is away from of the developer carrier, wherein the developer container part includes a developer reception port above the first and second developer supply members wherein the developer reception port is configured for filling therethrough the developer in the developer container part; and wherein the second and third tangent lines are provided within the developer reception port.

5. The image formation unit according to claim 4, wherein a distance between an axis of the developer carrier and an axis of the first developer supply member in the horizontal direction is greater than a distance between the axis of the developer carrier and an axis of the second developer supply member in the horizontal direction.

6. The image formation unit according to claim 4, wherein the developer container part includes a developer reception port through which the developer is filled in the developer container part, and the developer reception port is above the first and second developer supply members.

7. The image formation unit according to claim 4, wherein the first developer supply member is provided upstream of the second developer supply member in a rotation direction of the developer carrier.

8. The image formation unit according to claim 4, further comprising a developer layer formation member provided downstream of the first and second developer supply members in a rotation direction of the developer carrier and configured to form a developer layer on the developer carrier.

9. The image formation unit according to claim 4, wherein the first developer supply member, the second developer supply member, and the developer carrier are configured to rotate in circumferential movement directions, respectively, and circumferential movement directions of the first developer supply member and the developer carrier are opposite to each other at a position where the first developer supply member and the developer carrier face each other.

10. The image formation unit according to claim 4, wherein the first developer supply member comprises plural rollers.

11. An image formation comprising:

an image carrier on which a latent image can be formed;

a developer carrier configured to retain a developer thereon and to supply the developer to the image carrier to form a developer image on the image carrier;

a first developer supply member configured to retain the developer thereon and to supply the developer to the developer carrier;

a second developer supply member provided above the first developer supply member, configured to retain the developer thereon and to supply the developer to the developer carrier; and a developer container part configured to contain therein the developer and accommodating therein the first and second developer supply members, wherein the first developer supply member protrudes out further than the second developer supply member toward an opposite side of the developer carrier, wherein a diameter of the first developer supply member is greater than a diameter of the second developer supply member, and wherein a distance between a first vertical line and a second vertical line is the same as a distance between the first vertical line and a third vertical line, where the first vertical line is a tangent line to the developer carrier, the second vertical line is a line passing through a center rotation axis of the first develop supply member and the third vertical line is a line passing through a rotation axis of the second developer supply member.

12. An image formation unit comprising;

an image carrier on which a latent image can be formed;

a developer carrier configured to retain a developer thereon and to supply the developer to the image carrier to form a developer image on the image carrier;

a first developer supply member configured to retain the developer thereon and to supply the developer to the developer carrier;

a second developer supply member configured to retain the developer thereon and to supply the developer to the developer carrier;

a first developer container room configured to contain therein the developer and accommodating therein the first developer supply member; and a second developer container room configured to contain therein the developer and accommodating therein the second developer supply member.

13. The image formation unit according to claim 12, further comprising a partition wall provided between and partitioning the first developer container room and the second developer container room.

14. The image formation unit according to claim 13, wherein the second developer supply member is above the first developer supply member, and the partition wall comprises a first wall portion and a second wall portion, wherein the first wall portion covers a part of the second developer member from under the second developer member and the second wall portion extends from an end of the first wall portion to a position above the second developer supply member.

15. The image formation unit according to claim 12, wherein the first developer supply member is provided upstream of the second developer supply member in a rotation direction of the developer carrier.

16. The image formation unit according to claim 12, further comprising a first agitation member in the first developer container room configured to agitate the toner in the first developer container room; and a second agitation member in the second developer container room configured to agitate the toner in the second developer container room.

17. The image formation unit according to claim 12, further comprising a third developer container room configured to distribute therefrom the developer into the first developer container room and the second developer container room.

18. An image formation apparatus comprising:

the image formation unit according to claim 12.

19. An image formation unit comprising:

an image carrier on which a latent image can be formed;

a developer carrier configured to retain a developer thereon and to supply the developer to the image carrier to form a developer image on the image carrier;

a first developer supply member configured to retain the developer thereon and to supply the developer to the developer carrier;

a second developer supply member provided above the first developer supply member and configured to retain the developer thereon and to supply the developer to the developer carrier; and a developer container part configured to contain therein the developer and accommodating therein the first and second developer supply members; and wherein the developer container part includes; a developer reception port configured to fill therethrough the developer in the developer container part; and a first wall portion that faces the first and second developer supply members and extends from the side of the developer reception port toward the side of the first and second developer supply members, and wherein the first developer supply member protrudes out further than the second developer supply member toward an opposite side of the developer carrier in a direction orthogonal to a direction of extending the first wall portion.

20. An image formation unit comprising:

an image carrier on which a latent image can be formed;

a developer carrier configured to retain a developer thereon and to supply the developer to the image carrier to form a developer image on the image carrier;

a first developer supply member configured to retain the developer thereon and to supply the developer to the developer carrier;

a second developer supply member provided above the first developer supply member in a vertical direction and configured to retain the developer thereon and to supply the developer to the developer carrier;

a developer container part configured to contain therein the developer and accommodating therein the first and second developer supply members, wherein the developer container part includes a developer reception port provided above the first and second developer supply members in the vertical direction, and wherein a first vertical tangent line to the first developer supply member that is away from the developer carrier and a second vertical tangent line to the second developer supply member that is away from the developer carrier are both provided within the developer reception port.

* * * * *